US011136178B1

(12) United States Patent
Shovan

(10) Patent No.: US 11,136,178 B1
(45) Date of Patent: Oct. 5, 2021

(54) THERMALLY INSULATING BEVERAGE JACKETS, METHOD OF USE, AND METHOD OF MANUFACTURING

(71) Applicant: Jason J. Shovan, Chesterfield, MI (US)

(72) Inventor: Jason J. Shovan, Chesterfield, MI (US)

( * ) Notice: Subject to any disclaimer, the term of this patent is extended or adjusted under 35 U.S.C. 154(b) by 4 days.

(21) Appl. No.: 16/525,308

(22) Filed: Jul. 29, 2019

Related U.S. Application Data

(60) Provisional application No. 62/734,253, filed on Sep. 20, 2018.

(51) Int. Cl.

| | |
|---|---|
| ***B65D 81/38*** | (2006.01) |
| ***A47G 23/02*** | (2006.01) |
| ***B65D 41/62*** | (2006.01) |
| *B65D 1/26* | (2006.01) |

(52) U.S. Cl.
CPC ..... *B65D 81/3881* (2013.01); *A47G 23/0266* (2013.01); *B65D 81/3879* (2013.01); *A47G 23/0216* (2013.01); *A47G 2023/0291* (2013.01); *B65D 1/26* (2013.01); *B65D 41/62* (2013.01)

(58) Field of Classification Search
CPC ..... B65D 81/3881; B65D 81/3876; B65D 81/3867; B65D 81/3886; A47G 23/0216; A47G 23/0208; A47G 2023/0291; A47G 2023/0283; A47G 2023/0275; A47G 23/0266
USPC ..... 220/739, 903; D7/607
See application file for complete search history.

(56) References Cited

U.S. PATENT DOCUMENTS

| | | | | |
|---|---|---|---|---|
| 2,568,623 | A | 9/1951 | Hamm | |
| 2,641,402 | A | 6/1953 | Johannes | |
| 2,685,318 | A * | 8/1954 | Merkle | B65D 81/3897 215/395 |
| 4,282,279 | A * | 8/1981 | Strickland | B65D 25/34 150/901 |
| 4,293,015 | A * | 10/1981 | McGough | B65D 81/3886 220/739 |
| 4,462,444 | A * | 7/1984 | Larson | B65D 81/3886 215/12.1 |
| 4,548,349 | A | 10/1985 | Tunberg | |
| 4,831,842 | A * | 5/1989 | Kelley | F25D 3/08 220/903 |
| D347,553 | S * | 6/1994 | Schneider | D7/607 |
| 6,425,494 | B1 | 7/2002 | Woods | |
| 7,228,987 | B2 | 6/2007 | Jones | |
| 7,238,403 | B2 | 7/2007 | Koslow et al. | |
| 9,856,068 | B2 | 1/2018 | Jody | |

(Continued)

*Primary Examiner* — James N Smalley
*Assistant Examiner* — Jennifer Castriotta
(74) *Attorney, Agent, or Firm* — Buckert Patent & Trademark Law Firm PC; John F. Buckert

(57) ABSTRACT

A thermally insulating beverage jacket is provided. The thermally insulating beverage jacket includes a first flexible tubular-shaped portion having first and second surfaces disposed opposite to one another. The first surface defines a first interior region with a first diameter in a first operational position of the thermally insulating beverage jacket. The first flexible tubular-shaped portion is centered about a longitudinal axis. The thermally insulating beverage jacket includes a second flexible tubular-shaped portion coupled to the second surface of the first flexible tubular-shaped portion and having at least first and second air gaps therebetween in the first operational position of the thermally insulating beverage jacket.

17 Claims, 27 Drawing Sheets

(56) References Cited

U.S. PATENT DOCUMENTS

| | | | | |
|---|---|---|---|---|
| 2008/0164269 | A1* | 7/2008 | Vorderkunz | B65D 81/3876<br>220/739 |
| 2014/0091099 | A1* | 4/2014 | Prchal | A47G 23/04<br>220/592.17 |

* cited by examiner

THERMALLY INSULATING BEVERAGE JACKETS, METHOD OF USE, AND METHOD OF MANUFACTURING

BACKGROUND

A beverage jacket has been utilized hold a standard-sized beverage container (e.g., 66 mm diameter beverage container) therein. A problem associated with the beverage jacket is that the beverage jacket is not capable of firmly holding a relatively small diameter beverage container (e.g., 52 mm diameter beverage container) therein. As a result, when a user attempts to place the small diameter beverage container within the beverage jacket, and grabs only a top portion of the beverage container, the beverage jacket may undesirably fall off of the beverage container.

The inventor herein has recognized a need for a thermally insulating beverage jacket that can firmly hold standard sized beverage containers and small diameter beverage containers therein, such that the beverage jacket does not fall off of the containers when a user grabs the top portion of the beverage container, and prevents beverage container slippage inside the beverage jacket when the user grabs the beverage jacket to take a drink from the beverage container.

SUMMARY

A thermally insulating beverage jacket in accordance with an exemplary embodiment is provided. The thermally insulating beverage jacket includes a first flexible tubular-shaped portion having first and second surfaces disposed opposite to one another. The first surface defines a first interior region with a first diameter in a first operational position of the thermally insulating beverage jacket. The first flexible tubular-shaped portion is centered about a longitudinal axis. The thermally insulating beverage jacket further includes a second flexible tubular-shaped portion coupled to the second surface of the first flexible tubular-shaped portion and having at least first and second air gaps therebetween in the first operational position of the thermally insulating beverage jacket. In the first operational position of the thermally insulating beverage jacket in which the second flexible tubular-shaped portion is disposed radially outwardly from the longitudinal axis a greater distance than the first flexible tubular-shaped portion, the first flexible tubular-shaped portion has the first interior region and stretches to receive a first beverage container having a second diameter that is greater than the first diameter and to firmly hold the first beverage container therein. In a second operational position of the thermally insulating beverage jacket in which the thermally insulating beverage jacket is turned inside-out, and the second flexible tubular-shaped portion is disposed in a second interior region defined by the second surface of the first flexible tubular-shaped portion, the second flexible tubular-shaped portion forms at least first and second protrusions, respectively, that extend inwardly toward the longitudinal axis, and the second flexible tubular-shaped portion defines a third interior region and stretches to receive a second beverage container having a third diameter that is smaller than the first diameter and to firmly hold the second beverage container therein.

A method of using a thermally insulating beverage jacket in accordance with another exemplary embodiment is provided. The method includes providing the thermally insulating beverage jacket having first and second flexible tubular-shaped portions. The first flexible tubular-shaped portion has first and second surfaces disposed opposite to one another. The first surface defines a first interior region with a first diameter in a first operational position of the thermally insulating beverage jacket. The first flexible tubular-shaped portion is centered about a longitudinal axis. The second flexible tubular-shaped portion is coupled to the second surface of the first flexible tubular-shaped portion and has at least first and second air gaps therebetween in the first operational position of the thermally insulating beverage jacket. The method includes moving the thermally insulating beverage jacket to the first operational position in which the second flexible tubular-shaped portion is disposed radially outwardly from the longitudinal axis a greater distance than the first flexible tubular-shaped portion. The method further includes inserting a first beverage container in the first interior region such that the first flexible tubular-shaped portion stretches to receive the first beverage container and to firmly hold the first beverage container therein. The first beverage container has a second diameter that is greater than the first diameter.

A method of manufacturing a thermally insulating beverage jacket in accordance with another exemplary embodiment is provided. The method includes cutting first and second flexible layers and a multi-component layer from a sheet of flexible material. The first and second flexible layers each are rectangular-shaped. The multi-component layer has first and second flexible portions and an end flexible portion integrally coupled to and between the first and second flexible portions. The multi-component layer extends along a longitudinal axis. The method includes coupling the first flexible layer to the first flexible portion such that first and second air gaps are disposed therebetween. The method further includes coupling the second flexible layer to the second flexible portion such that third and fourth air gaps are disposed therebetween. The method further includes folding the end flexible portion such that the first and second flexible portions contact one another. The method further includes sewing a first plurality of stitches through a first end portion of the first flexible layer, a first end portion of the first flexible portion, a first end portion of the second flexible layer, and a first end portion of the second flexible portion. The method further includes sewing a second plurality of stitches through a second end portion of the first flexible layer, a second end portion of the first flexible portion, a second end portion of the second flexible layer, and a second end portion of the second flexible portion.

A method of manufacturing a thermally insulating beverage jacket in accordance with another exemplary embodiment is provided. The method includes cutting a multi-component layer from a sheet of flexible material. The multi-component layer has a first flexible portion and first and second end tab portions. The first flexible portion has first and second end portions. The multi-component layer extends along a longitudinal axis. The method further includes coupling a second flexible portion to the first flexible portion such that first and second air gaps are disposed therebetween. The second flexible portion has first and second end portions that that are disposed on and coupled to the first and second end portions, respectively, of the first flexible portion. The method further includes folding the first flexible portion such that the first and second end portions thereof abut against one another, and the first and second end portions of the second flexible portion abut against one another. The method further includes sewing a first plurality of stitches through the first and second end portions of the first flexible portion and the first and second end portions of the second flexible portion.

DETAILED DESCRIPTION

Referring to FIGS. 1-25, a thermally insulating beverage jacket 20 in accordance with an exemplary embodiment that holds a beverage container 22 therein is illustrated. The thermal insulating beverage jacket 20 reduces an amount of heat energy transferred from a user's hand to the beverage container 22.

An advantage of the thermally insulating beverage jacket 20 is that the jacket 20 can firmly hold beverage cans having a plurality of different sizes therein. In particular, the thermally insulating beverage jacket 20 can hold beverage containers having diameters in a range of 52-74 mm in diameter. Thus, the user does not have to have multiple beverage jackets for use with multiple beverage containers having different sizes. The beverage container 22 is a standard-sized beverage container having a 66 mm diameter.

The term "firmly hold" used herein means that a thermally insulating beverage jacket holding a beverage container therein, stays affixed to the beverage container when a user grabs a top portion of a beverage container without contacting the thermally insulating beverage jacket and lifts the beverage container and shakes the beverage container two or more times.

Figure 2:
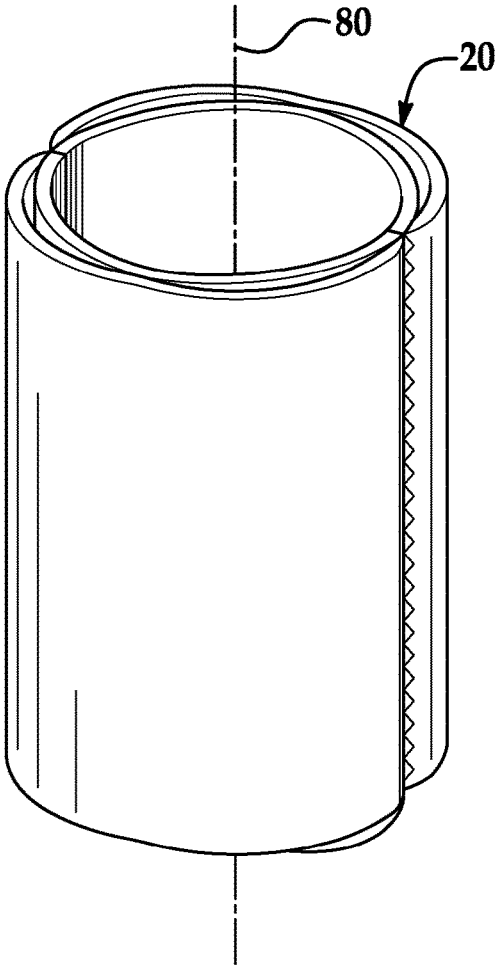
FIG. 2 is a schematic of the thermally insulating beverage jacket of FIG. 1 in a first operational position prior to the first beverage container being disposed therein.

As an overview, the thermally insulating beverage jacket 20 has a first operational position shown in FIG. 2 for holding beverage containers/cans having a diameter in a range of 61-74 millimeters. Further, the thermally insulating beverage jacket 20 can be turned inside out to have a second operational position shown in FIG. 17 for holding small diameter beverage containers having a diameter in a range of 52-66 millimeters.

Referring to FIGS. 1-3, 8, and 34, the thermally insulating beverage jacket 20 includes a first flexible tubular-shaped portion 30, a second flexible tubular-shaped portion 32, an end flexible portion 34 (shown in FIG. 8), a first plurality of stitches 36 (shown in FIG. 1), a second plurality of stitches 38 (shown in FIG. 8), adhesive layers 40, 41, 42, 43, 44, 45 (shown in FIG. 34), first, second, and third interior regions 50, 52, 54, and air gaps 60, 62, 64, 66. The thermally insulating beverage jacket 20 extends along a longitudinal axis 80 and is centered about the longitudinal axis 80.

The structure of the thermally insulating beverage jacket 20 will initially be described with figures illustrating the thermally insulating beverage jacket 20 in a first operational position when a beverage container is not disposed within the thermally insulating beverage jacket 20.

Figure 3:
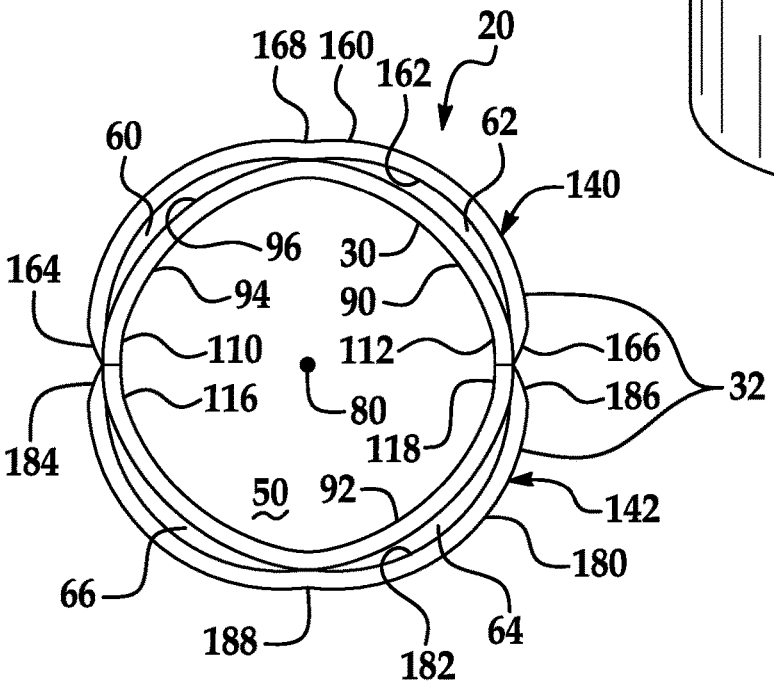
FIG. 3 is a cross-sectional schematic of the thermally insulating beverage jacket of FIG. 1 in the first operational position for receiving the first beverage container therein.
Figure 4:
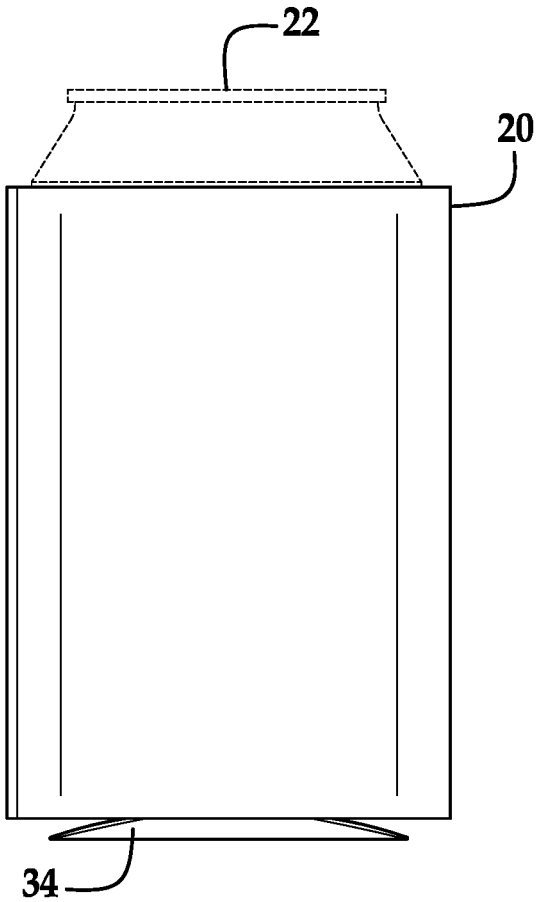
FIG. 4 is a side view of the first beverage container and the thermally insulating beverage jacket of FIG. 1.
Figure 5:
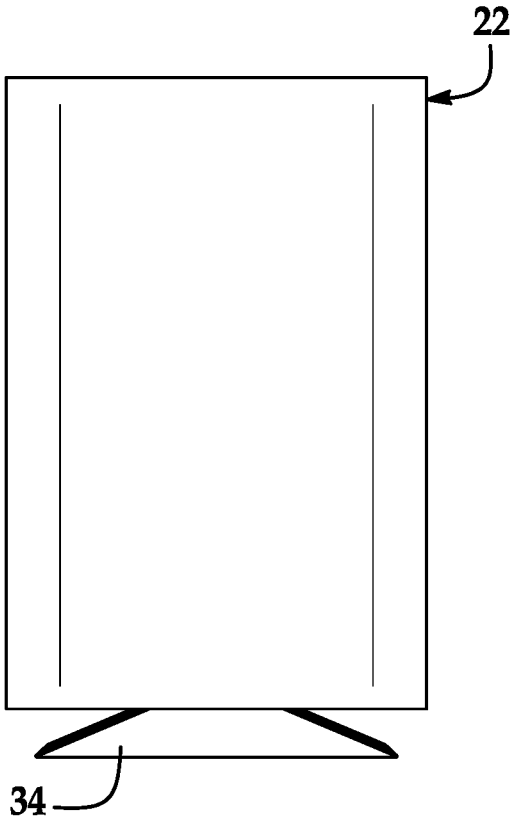
FIG. 5 is a side view of the thermally insulating beverage jacket of FIG. 2.
Figure 6:
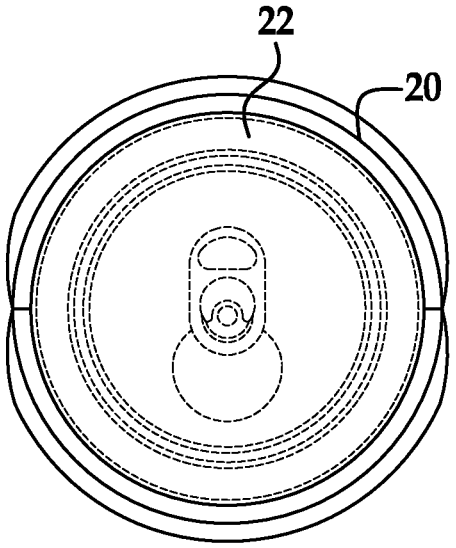
FIG. 6 is a top view of the first beverage container and the thermally insulating beverage jacket of FIG. 1.
Figure 7:
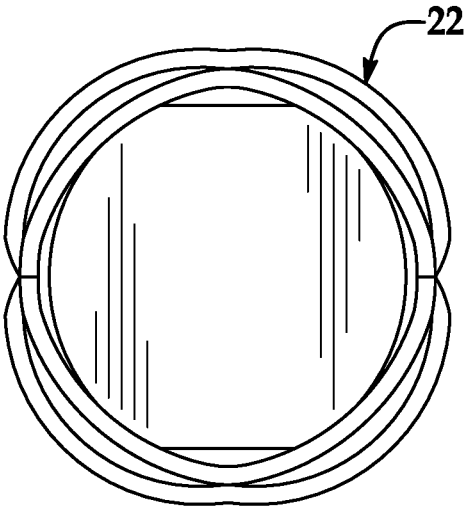
FIG. 7 is a top view of the thermally insulating beverage jacket of FIG. 2.

Referring to FIG. 3, the first flexible tubular-shaped portion 30 includes a first flexible portion 90, a second flexible portion 92, a first surface 94 (defined by first and second portions 90, 92), and a second surface 96 (defined by first and second portions 90, 92). The first and second surfaces 94, 96 are disposed opposite to one another and each extend 360 degrees. The first flexible portion 90 has an arcuate cross-sectional profile and includes a first end portion 110 and a second end portion 112. The second flexible portion 92 has an arcuate cross-sectional profile and includes a first end portion 116 and a second end portion 118.

Figure 1:
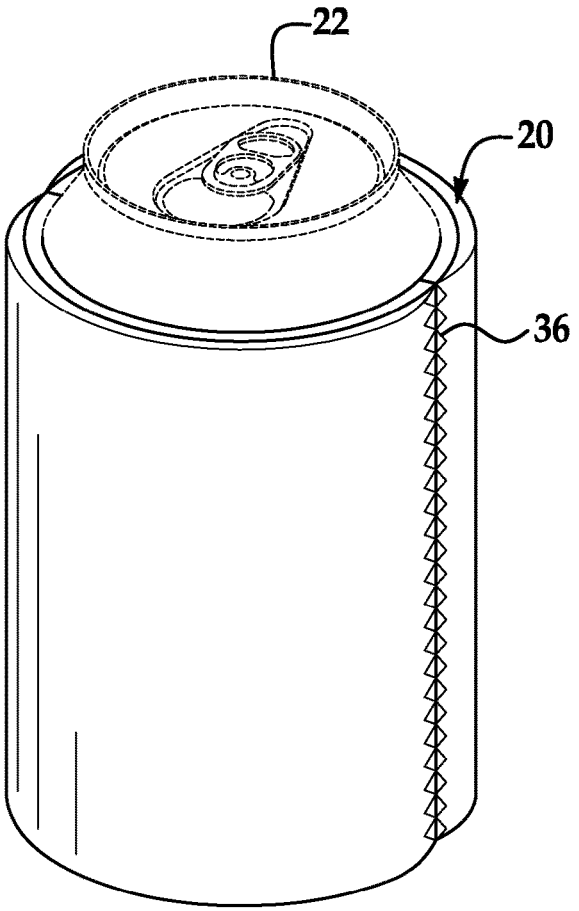
FIG. 1 is a schematic of a first beverage container (e.g., standard diameter beverage container) disposed within a thermally insulating beverage jacket, in accordance with an exemplary embodiment.

The first end portion 110 of the first flexible portion 90 abuts against the first end portion 116 of the second flexible portion 92 and is coupled thereto utilizing a first plurality of stitches 36 (shown in FIG. 1).

Figure 8:
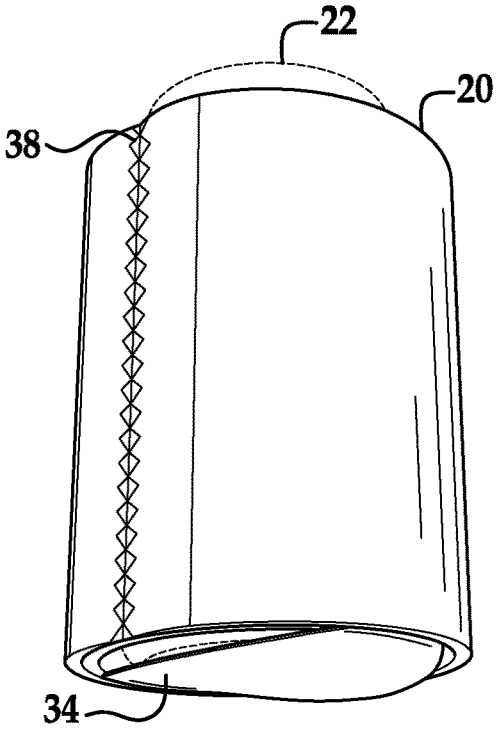
FIG. 8 is an isometric view of the first beverage container and the thermally insulating beverage jacket of FIG. 1.
Figure 9:
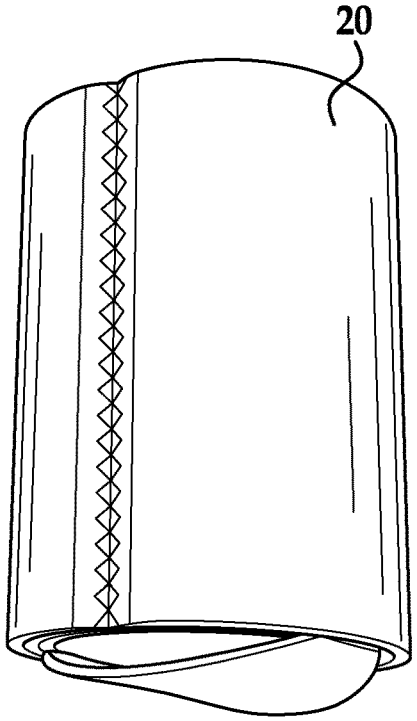
FIG. 9 is an isometric view of the thermally insulating beverage jacket of FIG. 2.
Figure 10:
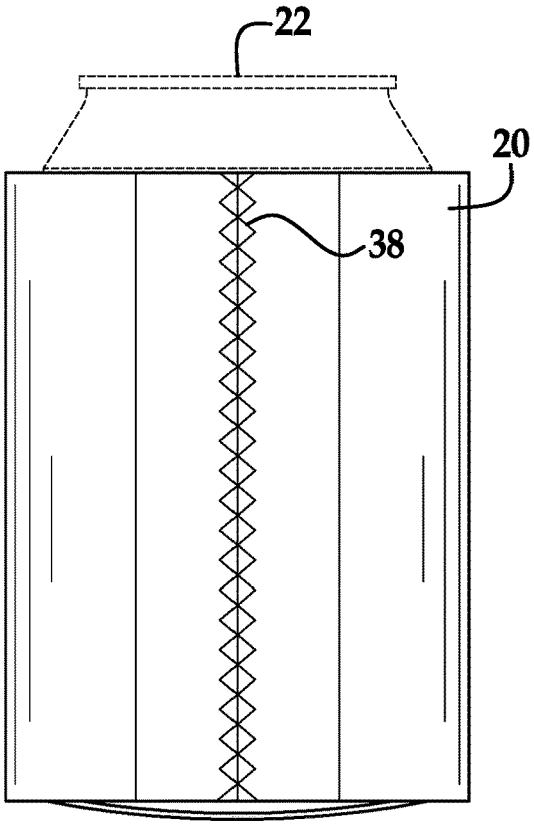
FIG. 10 is another side view of the first beverage container and the thermally insulating beverage jacket of FIG. 1.
Figure 11:
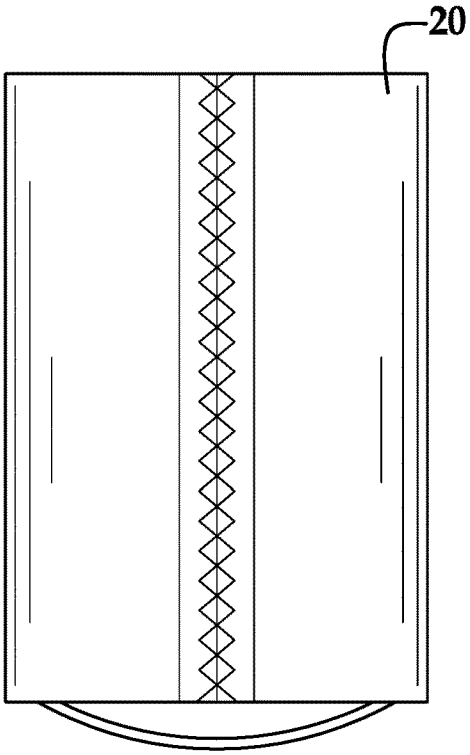
FIG. 11 is another side view of the thermally insulating beverage jacket of FIG. 2.
Figure 12:
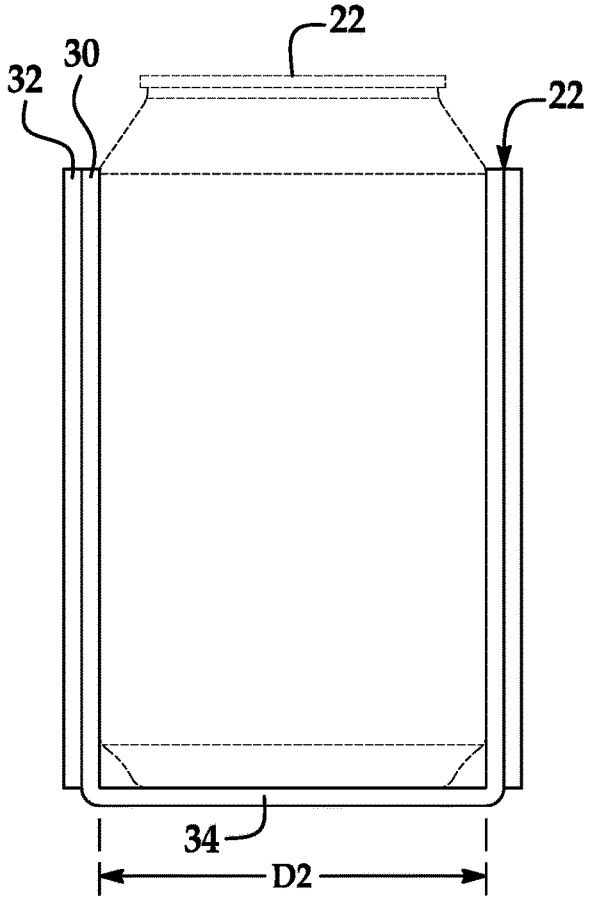
FIG. 12 is a cross-sectional view of the first beverage container and the thermally insulating beverage jacket of FIG. 1.

The second end portion 112 of the first flexible portion 90 abuts against the second end portion 118 of the second flexible portion 92 and is coupled thereto utilizing a second plurality of stitches 38 (shown in FIG. 8). The first surface 94 defines a first interior region 50 having a first diameter in the first operational position of the thermally insulating beverage jacket 20.

In an exemplary embodiment, the first flexible tubular-shaped portion 30 is constructed from a flexible open cell foam material. In another exemplary embodiment, the first flexible tubular-shaped portion 30 is constructed from a flexible open cell foam material covered with a thin fabric layer. In another exemplary embodiment, the first flexible tubular-shaped portion 30 is constructed of a flexible closed cell foam material. In another exemplary embodiment, the first flexible tubular-shaped portion 30 is constructed of a flexible closed cell foam material covered by a thin fabric layer. In another exemplary embodiment, the first flexible tubular-shaped portion 30 is constructed of a flexible silicone material. In another exemplary embodiment, the first flexible tubular-shaped portion 30 is constructed of a flexible silicone material covered with a thin layer of fabric. The first flexible tubular-shaped portion 30 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

The second flexible tubular-shaped portion 32 includes a first flexible layer 140 and a second flexible layer 142.

The first flexible layer 140 includes a first surface 160, a second surface 162, a first end portion 164, a second end portion 166, and an intermediate portion 168. The first and second surfaces 160, 162 are disposed opposite to one another. The first and second end portions 164, 166 and the intermediate portion 168 are coupled to and contact the second surface 96 of the first flexible tubular-shaped portion 30 such that the air gaps 60, 62 are formed between the first flexible layer 140 and the second surface 96 of the first flexible tubular-shaped portion 30 when a beverage container is not disposed in the thermally insulating beverage jacket 20. The first and second end portions 164, 166 and the intermediate portion 168 are coupled to the second surface 96 of the first flexible tubular-shaped portion 30 utilizing an adhesive, or stitches, or thermal weld joints. In an exemplary embodiment, the first and second end portions 164, 166 are each wedge-shaped. Further, the first flexible layer 140 extends around substantially 180 degrees of the first flexible tubular-shaped portion 30.

The second flexible layer 142 includes a first surface 180, a second surface 182, a first end portion 184, a second end portion 186, and an intermediate portion 188. The first and second surfaces 180, 182 are disposed opposite to one another. The first and second end portions 184, 186 and the intermediate portion 188 are coupled to and contact the second surface 96 of the first flexible tubular-shaped portion 30 such that the air gaps 64, 66 are formed between the second flexible layer 142 and the second surface 96 of the first flexible tubular-shaped portion 30 when the first beverage container is not disposed in the thermally insulating beverage jacket 20. The first and second end portions 164, 166 and the intermediate portion 168 are coupled to the second surface 96 of the first flexible tubular-shaped portion 30 utilizing an adhesive, or stitches, or thermal weld joints. In an exemplary embodiment, the first and second end portions 184, 186 are each wedge-shaped. Further, the second flexible layer 142 extends around substantially 180 degrees of the first flexible tubular-shaped portion 30.

In an exemplary embodiment, the second flexible tubular-shaped portion 32 is constructed from a flexible open cell foam material. In another exemplary embodiment, the second flexible tubular-shaped portion 32 is constructed from a flexible open cell foam material covered with a thin fabric layer. In another exemplary embodiment, the second flexible tubular-shaped portion 32 is constructed of a flexible closed cell foam material. In another exemplary embodiment, the second flexible tubular-shaped portion 32 is constructed of a flexible closed cell foam material covered by a thin fabric layer. In another exemplary embodiment, the second flexible tubular-shaped portion 32 is constructed of a flexible silicone material. In another exemplary embodiment, the second flexible tubular-shaped portion 32 is constructed of a flexible silicone material covered with a thin layer of fabric. The second flexible tubular-shaped portion 32 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

Referring to FIGS. 1 and 3, in an exemplary embodiment, a first plurality of stitches 36 extend through the first end portion 164 of the first flexible layer 140 of the second flexible tubular-shaped portion 32, the first end portion 110 of the first flexible portion 90 of the first flexible tubular-shaped portion 30, the first end portion 184 of the second flexible layer 142 of the second flexible tubular-shaped portion 32, and the first end portion 116 of the second flexible portion 92 of the first flexible tubular-shaped portion 30.

Further, referring to FIGS. 3 and 8, in an exemplary embodiment, a second plurality of stitches 38 extend through the second end portion 166 of the first flexible layer 140 of the second flexible tubular-shaped portion 32, the second end portion 112 of the first flexible portion 90 of the first flexible tubular-shaped portion 30, the second end portion 186 of the second flexible layer 142 of the second flexible tubular-shaped portion 32, and the second end portion 118 of the second flexible portion 92 of the first flexible tubular-shaped portion 30.

Figure 13:
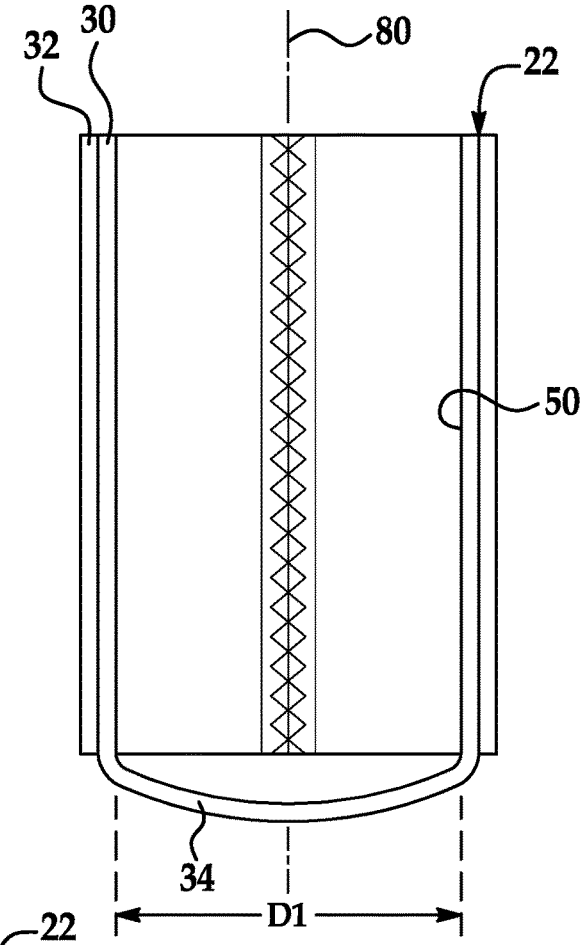
FIG. 13 is a cross-sectional view of the thermally insulating beverage jacket of FIG. 2.
Figure 14:
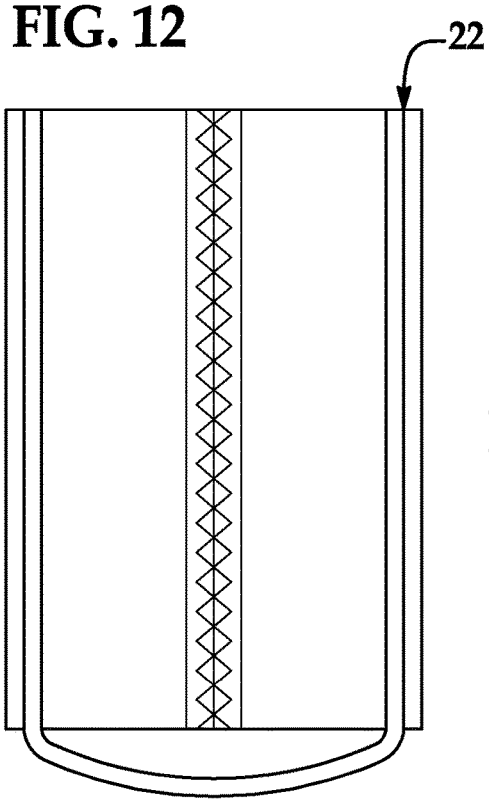
FIG. 14 is a cross-sectional view of the thermally insulating beverage jacket of FIG. 2 in a first operational position.

Referring to FIG. 13, the end flexible portion 34 is integrally coupled to a first end of the first flexible tubular-shaped portion 30. In an exemplary embodiment, the end flexible portion 34 is constructed from a flexible open cell foam material. In another exemplary embodiment, the end flexible portion 34 is constructed from a flexible open cell foam material covered with a thin fabric layer. In another exemplary embodiment, the end flexible portion 34 is constructed of a flexible closed cell foam material. In another exemplary embodiment, the end flexible portion 34 is constructed of a flexible closed cell foam material covered by a thin fabric layer. In another exemplary embodiment, the end flexible portion 34 is constructed of a flexible silicone material. In another exemplary embodiment, the end flexible portion 34 is constructed of a flexible silicone material covered with a thin layer of fabric. The end flexible portion 34 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

Referring to FIG. 13, in the first operational position of the thermally insulating beverage jacket 20, the second flexible tubular-shaped portion 32 (including first and second flexible layers 140, 142) is disposed radially outwardly from the longitudinal axis 80 a greater distance than the first flexible tubular-shaped portion 30. The first flexible tubular-shaped portion 30 has the first interior region 50 with a first diameter D1 and stretches to receive the beverage container 22 therein having a second diameter D2 that is greater than the first diameter D1 and to firmly hold the beverage container 22 therein.

The structure of the thermally insulating beverage jacket 20 will now be described with figures illustrating the thermally insulating beverage jacket 20 in a second operational position when a beverage container is not disposed within the thermally insulating beverage jacket 20.

Figure 25:
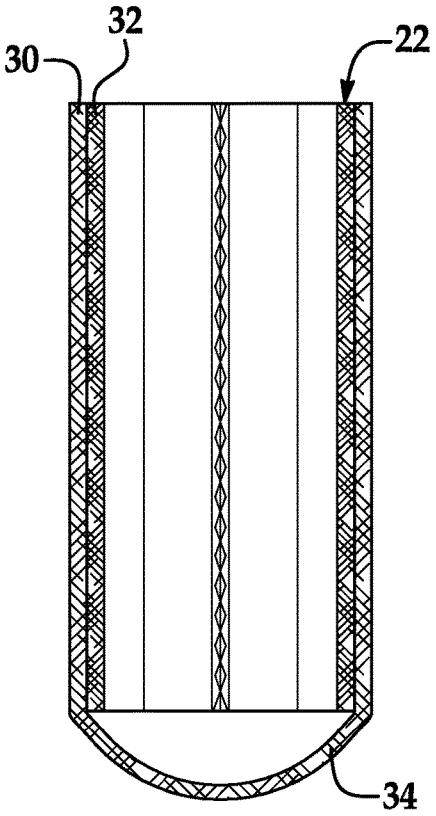
FIG. 25 is a cross-sectional view of the thermally insulating beverage jacket of FIG. 20 taken along lines 25-25.
Figure 26:
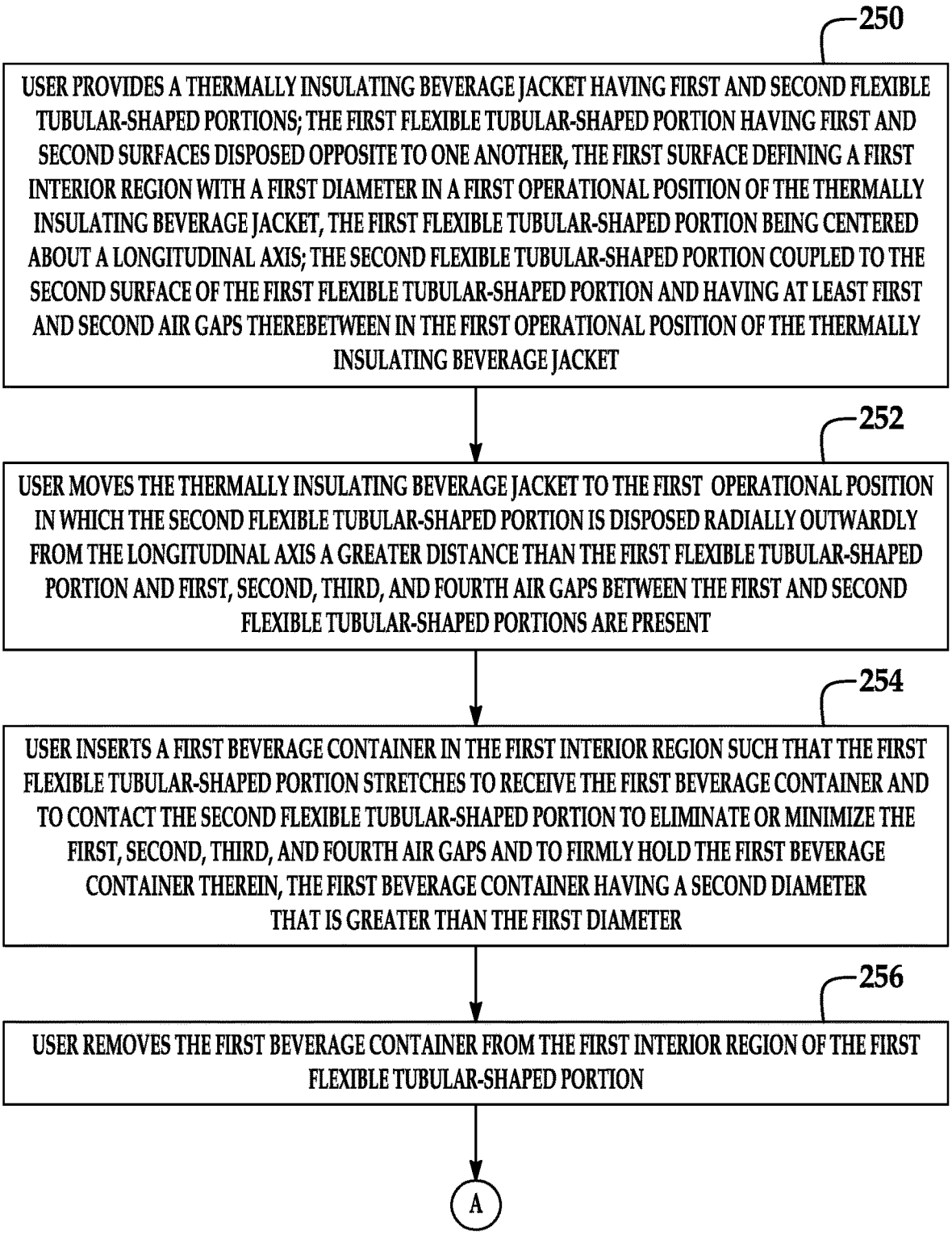
FIGS. 26-27 are flowcharts of the method of utilizing the thermally insulating beverage jacket of FIG. 1 in accordance with another exemplary embodiment.
Figure 27:
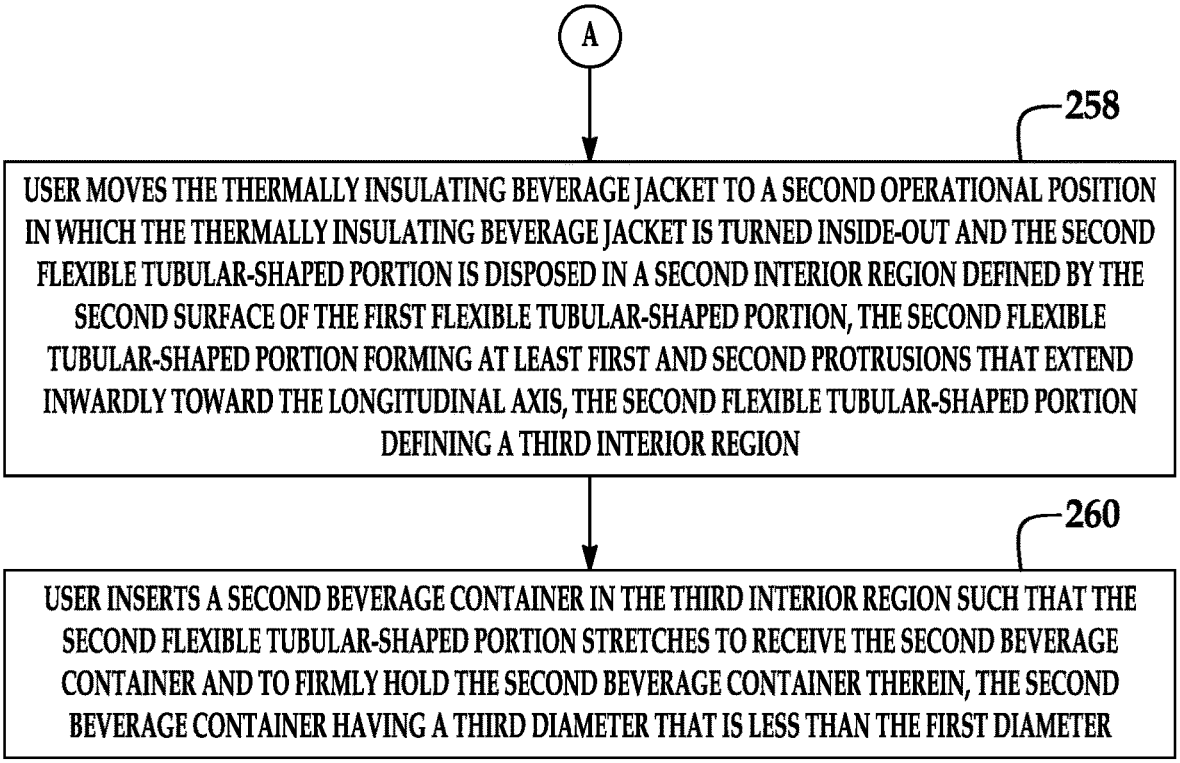

Referring to FIGS. 13 and 25, the thermally insulating beverage jacket 20 is transitioned from the first operational position (shown in FIG. 13) to a second operational position (shown in FIG. 25) by turning the beverage jacket 20 inside-out by pushing the end flexible portion 34 through an entire longitudinal length of the first interior region 50. Afterward, the second flexible tubular-shaped portion 32 is disposed in a second interior region 52 defined by the second surface 96 of the first flexible tubular-shaped portion 30. The second flexible tubular-shaped portion 32 (including flexible layers 140, 142) are disposed radially outwardly from the longitudinal axis 80 a smaller distance than the first flexible tubular-shaped portion 30 and forms protrusions 230, 232, 234, 236 that extend inwardly toward the longitudinal axis 80. The second flexible tubular-shaped portion 32 defines a third interior region 54 and stretches to receive a beverage container 220 therein having a third diameter D3 (shown in FIG. 21) that is smaller than the first diameter D1 (shown in FIG. 13) and to firmly hold the beverage container 220 therein.

Figure 15:
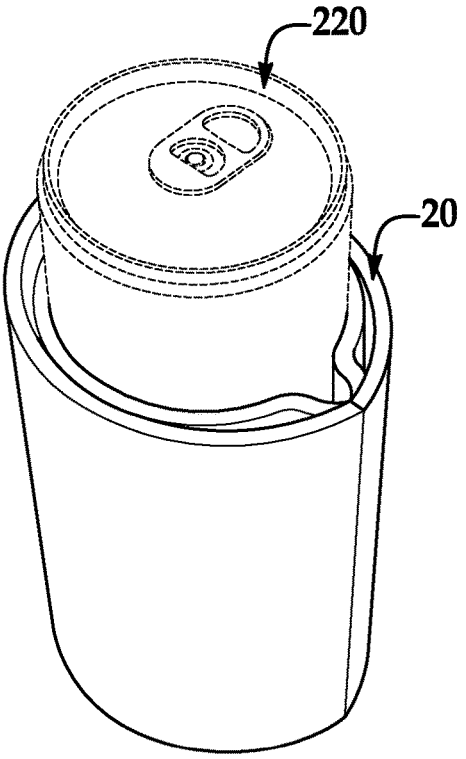
FIG. 15 is a schematic of a second beverage container (e.g., small diameter beverage container) disposed within the thermally insulating beverage jacket of FIG. 1.
Figure 18:
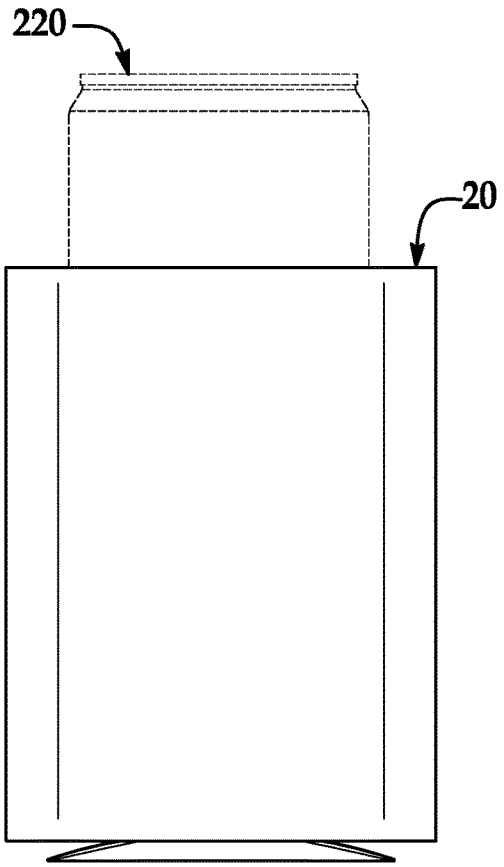
FIG. 18 is a side view of the second beverage container and the thermally insulating beverage jacket of FIG. 15.
Figure 21:
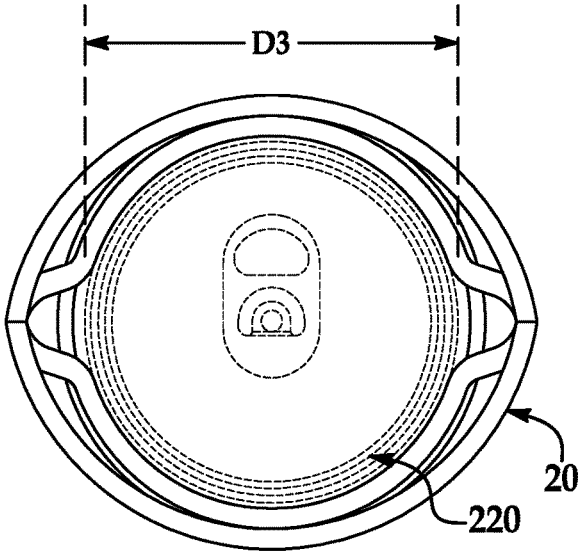
FIG. 21 is a top view of the second beverage container and the thermally insulating beverage jacket of FIG. 15.

Referring to FIGS. 15, 18, and 21, the thermally insulating beverage jacket 20 in the second operational position can receive the beverage container 220 therein and firmly hold the container 220 therein. The beverage container 220 has a 52 mm diameter and holds 8.4 ounces of fluid.

Figure 16:
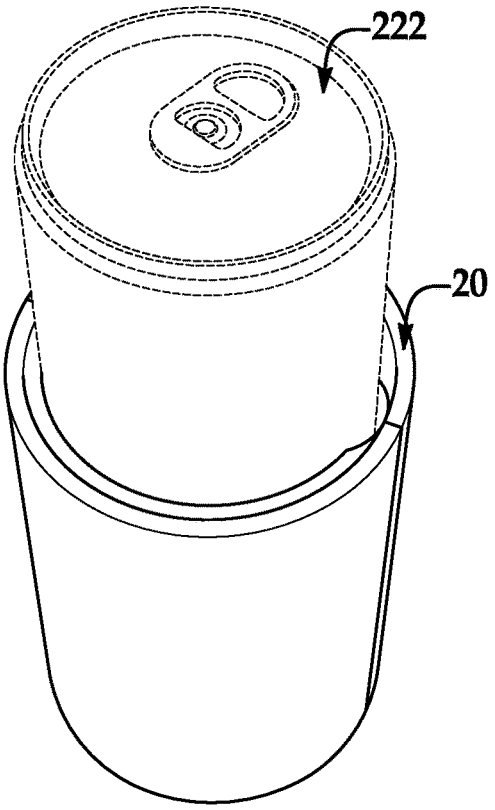
FIG. 16 is a schematic of a third beverage container (e.g., small diameter beverage container) disposed within the thermally insulating beverage jacket of FIG. 1.
Figure 17:
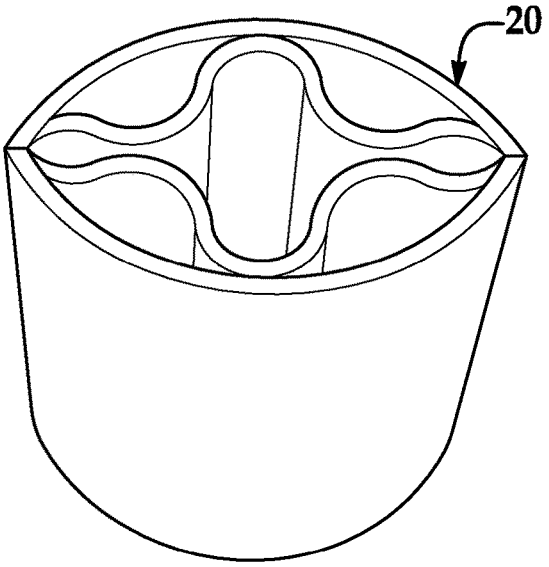
FIG. 17 is a schematic of the thermally insulating beverage jacket of FIG. 1 in a second operational position prior to the second or third beverage containers being disposed therein.
Figure 19:
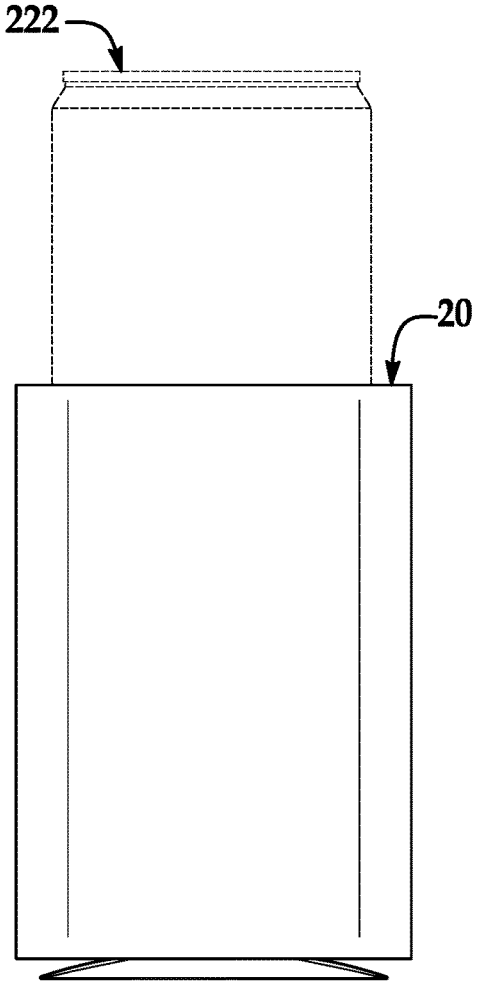
FIG. 19 is a side view of the third beverage container and the thermally insulating beverage jacket of FIG. 16.
Figure 20:
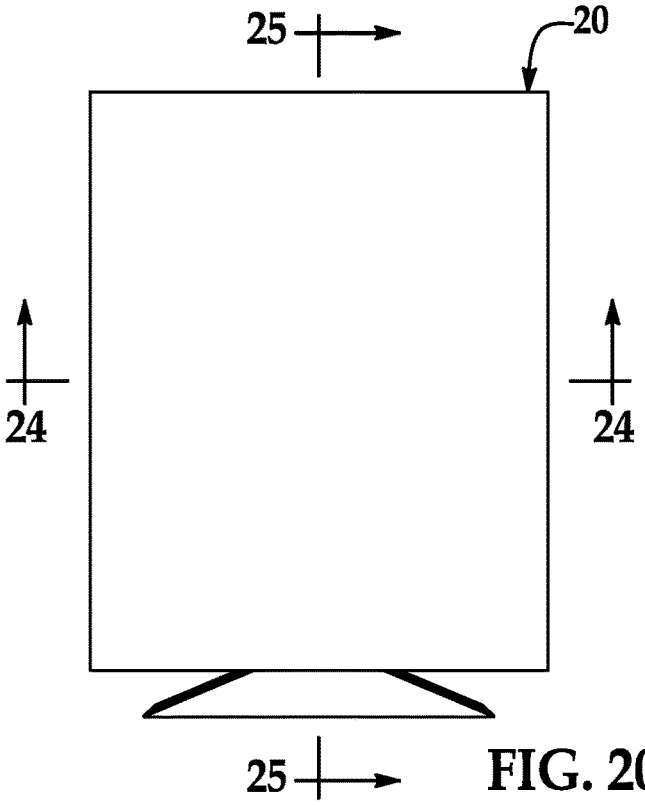
FIG. 20 is a side view of the thermally insulating beverage jacket of FIG. 17.
Figure 22:
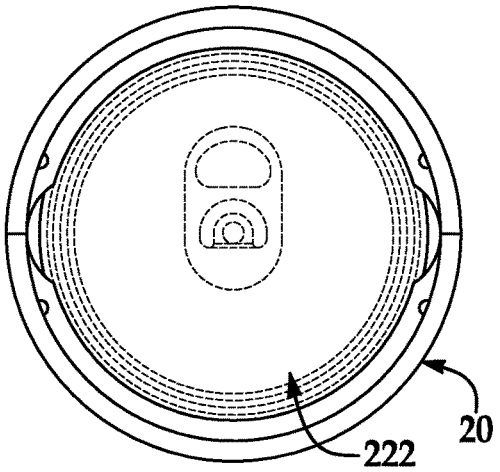
FIG. 22 is a top view of the third beverage container and the thermally insulating beverage jacket of FIG. 16.
Figure 23:
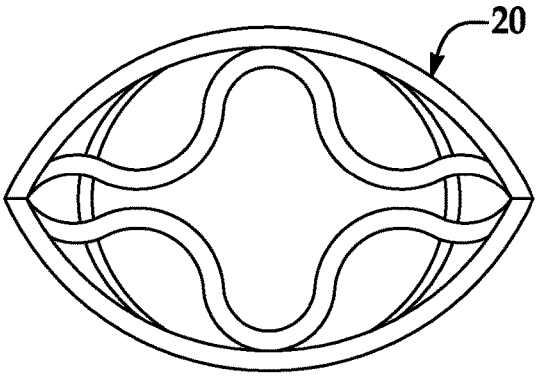
FIG. 23 is a top view of the thermally insulating beverage jacket of FIG. 17.

Referring to FIGS. 16, 19, and 22, the thermally insulating beverage jacket 20 in the second operational position can receive the beverage container 222 therein and firmly hold the container 222 therein. The beverage container 222 has a 57 mm diameter and holds 12 ounces of fluid.

Referring to FIGS. 1-3, 26 and 27, a flowchart of a method of using the thermally insulating beverage jacket 20 in accordance with another exemplary embodiment will now be explained.

At step 250, a user provides the thermally insulating beverage jacket 20 having the first and second flexible tubular-shaped portions 30, 32. The first flexible tubular-shaped portion 30 has first and second surfaces 94, 96 disposed opposite to one another. The first surface 94 defines the first interior region 50 with a first diameter in a first operational position of the thermally insulating beverage jacket 20. The first flexible tubular-shaped portion 30 is centered about a longitudinal axis 80. The second flexible tubular-shaped portion 32 is coupled to the second surface 96 of the first flexible tubular-shaped portion 30 and has at least first and second air gaps 60, 62 therebetween in the first operational position of the thermally insulating beverage jacket 20.

At step 252, the user moves the thermally insulating beverage jacket 20 to the first operational position in which the second flexible tubular-shaped portion 32 is disposed radially outwardly from the longitudinal axis 80 a greater distance than the first flexible tubular-shaped portion 30 and the air gaps 61, 62, 64, 66 between the first and second flexible tubular-shaped portions 30, 32 are present.

At step 254, the user inserts a first beverage container 22 in the first interior region 50 such that the first flexible tubular-shaped portion 30 stretches to receive the first beverage container 22 and to contact the second flexible tubular-shaped portion 32 to eliminate or minimize the air gaps 61, 62, 64, 66 and to firmly hold the first beverage container 22 (shown in FIG. 12) therein. The first beverage container 22 has a second diameter that is greater than the first diameter.

At step 256, the user removes the first beverage container 22 from the first interior region 50 of the first flexible tubular-shaped portion 30.

At step 258, the user moves the thermally insulating beverage jacket 20 to a second operational position in which the thermally insulating beverage jacket 20 is turned inside-out and the second flexible tubular-shaped portion 32 is disposed in a second interior region 52 defined by the second surface 96 of the first flexible tubular-shaped portion 30. The second flexible tubular-shaped portion 32 forms at least first and second protrusions 230, 232 that extend inwardly toward the longitudinal axis 80. The second flexible tubular-shaped portion 32 defines a third interior region 54.

At step 260, the user inserts a second beverage container 220 (shown in FIG. 15) in the third interior region 54 (shown in FIG. 3) such that the second flexible tubular-shaped portion 32 stretches to receive the second beverage container 220 and to firmly hold the second beverage container 220 therein. The second beverage container 220 has a third diameter D3 (shown in FIG. 21) that is less than the first diameter D1 (shown in FIG. 13.

Figure 28:
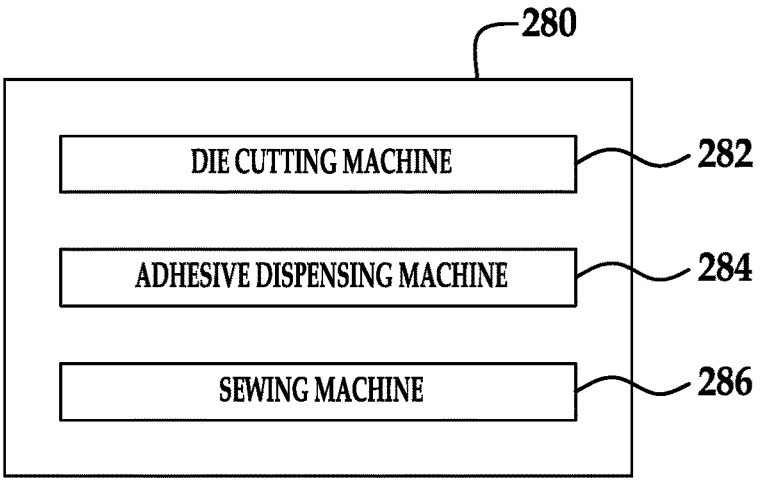
FIG. 28 is a block diagram of a system for manufacturing the thermally insulating beverage jacket of FIG. 1.
Figure 29:
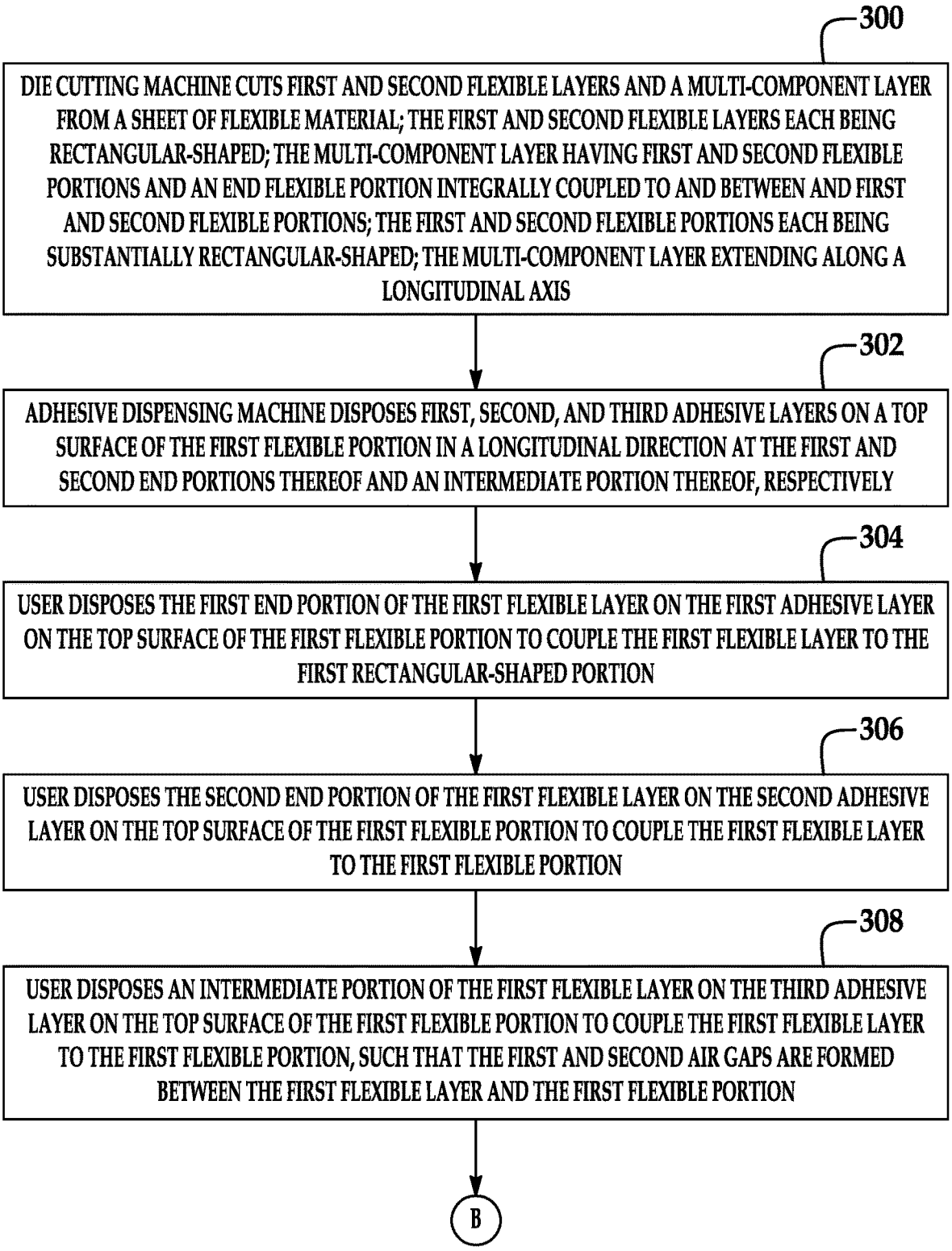
FIGS. 29-31 are flowcharts of the method of manufacturing the thermally insulating beverage jacket of FIG. 1 in accordance with another exemplary embodiment.
Figure 30:
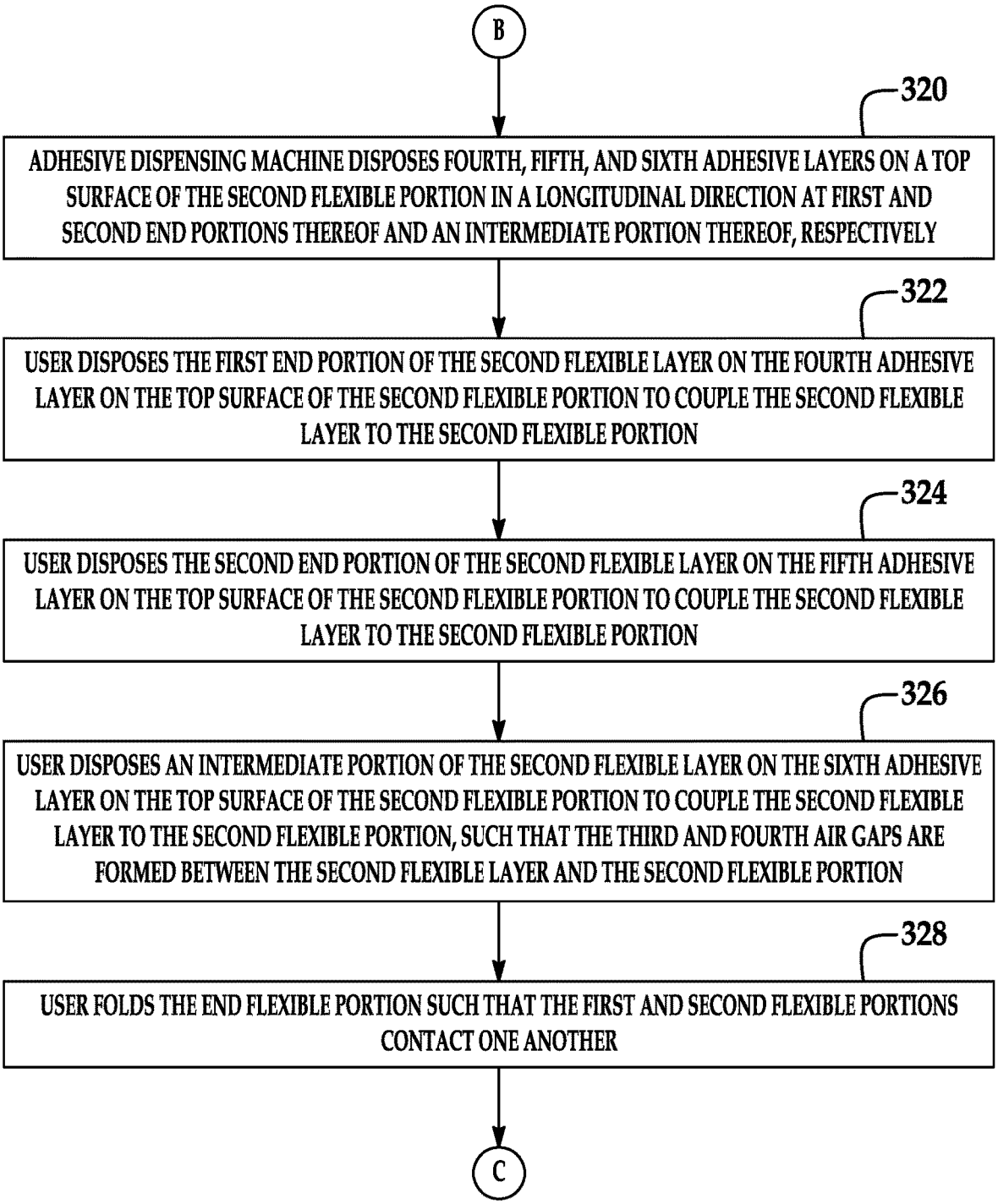
Figure 31:
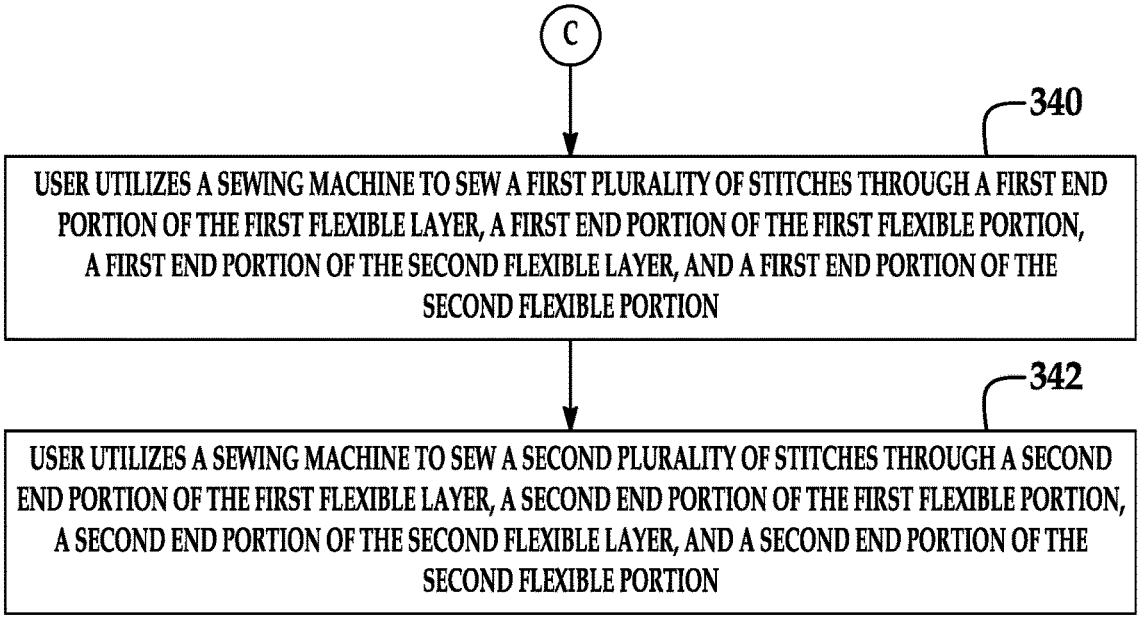

Referring to FIG. 28, a system 280 for manufacturing the thermally insulating beverage jacket 20 and the thermally insulating beverage jacket 520 is illustrated. The system 280 includes a die cutting machine 282, an adhesive dispensing machine 284, and a sewing machine 286. The functionality of the die cutting machine 282, the adhesive dispensing machine 284, and the sewing machine 286 will be described in greater detail hereinafter.

Referring to FIGS. 28, 29-31 and 32-42, a flowchart of a method of manufacturing the thermally insulating beverage jacket 20 in accordance with another exemplary embodiment will now be explained.

Figure 24:
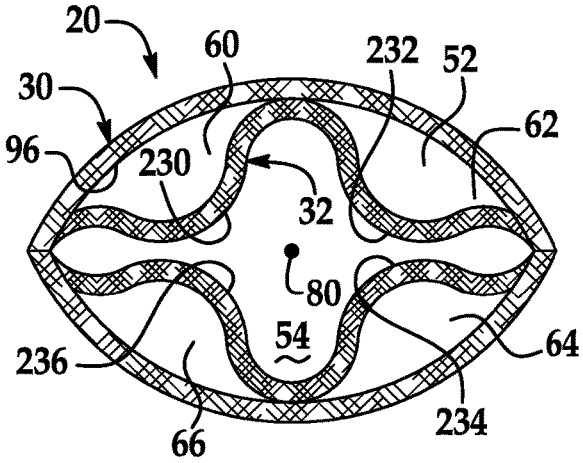
FIG. 24 is a cross-sectional schematic of the thermally insulating beverage jacket of FIG. 20 taken along lines 24-24.
Figure 32:
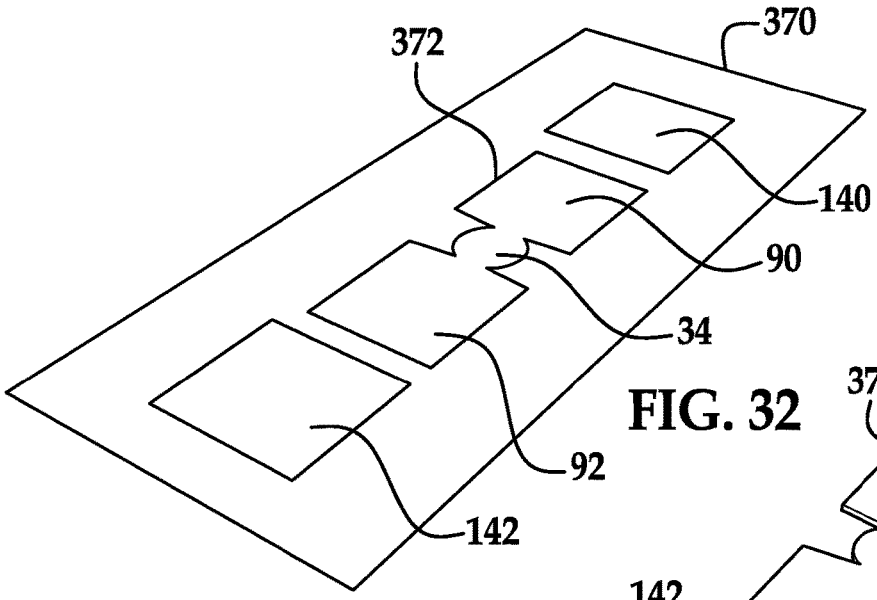
FIG. 32 is a schematic of a sheet of flexible material utilized to manufacture the thermally insulating beverage jacket of FIG. 1.
Figure 33:
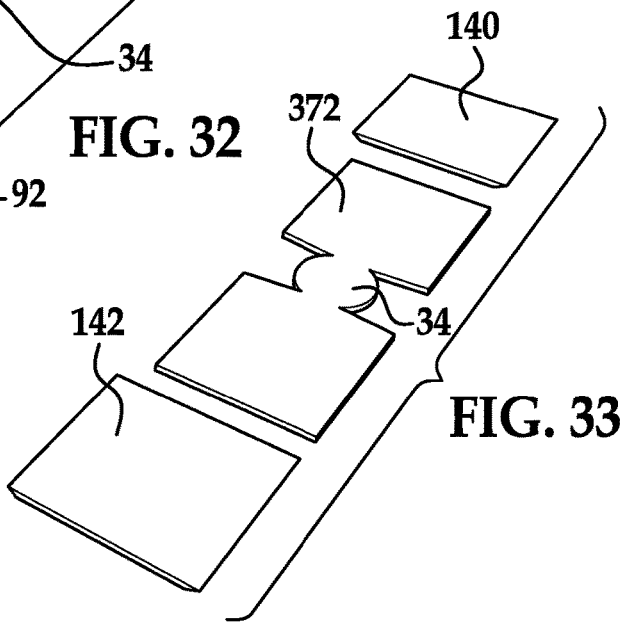
FIG. 33 is a schematic of a multi-component layer and first and second flexible layers that are cut from the sheet of flexible material of FIG. 32.

At step 300, the die cutting machine 282 cuts first and second flexible layers 140, 142 and a multi-component layer 372 from a sheet of flexible material 370 (shown in FIGS. 32-24). The first and second flexible layers 140, 142 each are rectangular-shaped. The multi-component layer 372 has first and second flexible portions 90, 92 and an end flexible portion 34 integrally coupled to and between the first and second flexible portions 90, 92. Each of the first and second flexible portions 90, 92 are substantially rectangular-shaped. The multi-component layer 372 extends along a longitudinal axis 299 (shown in FIG. 34). In an exemplary embodiment, the flexible material 370 is constructed from a flexible open cell foam material. In another exemplary embodiment, the flexible material 370 is constructed from a flexible open cell foam material covered with a thin fabric layer. In another exemplary embodiment, the flexible material 370 is constructed of a flexible closed cell foam material. In another exemplary embodiment, the flexible material 370 is constructed of a flexible closed cell foam material covered by a thin fabric layer. In another exemplary embodiment, the flexible material 370 is constructed of a flexible silicone material. In another exemplary embodiment, the flexible material 370 is constructed of a flexible silicone material covered with a thin layer of fabric. The flexible material 370 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

Figure 34:
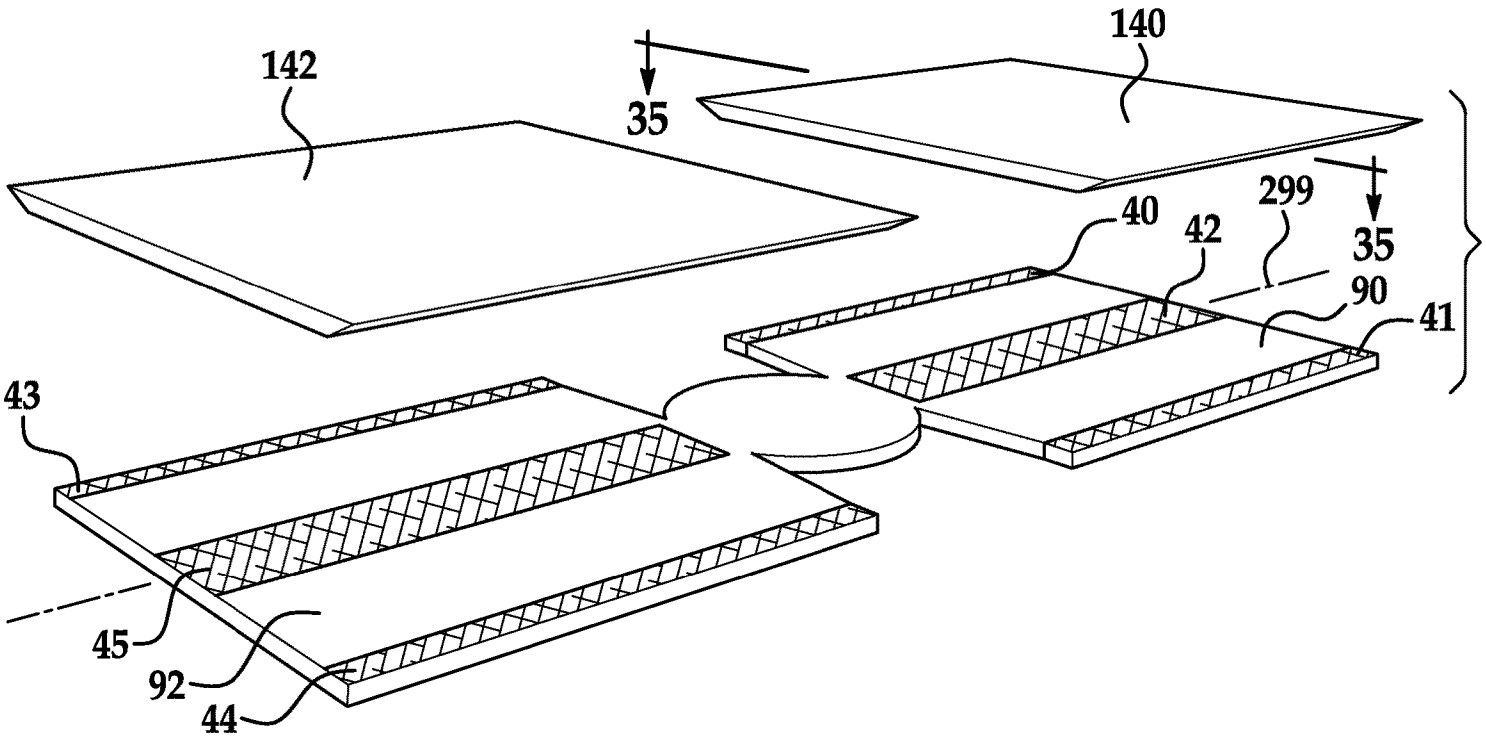
FIG. 34 is an isometric view of the multi-component layer and first and second flexible layers of FIG. 33.
Figure 35:
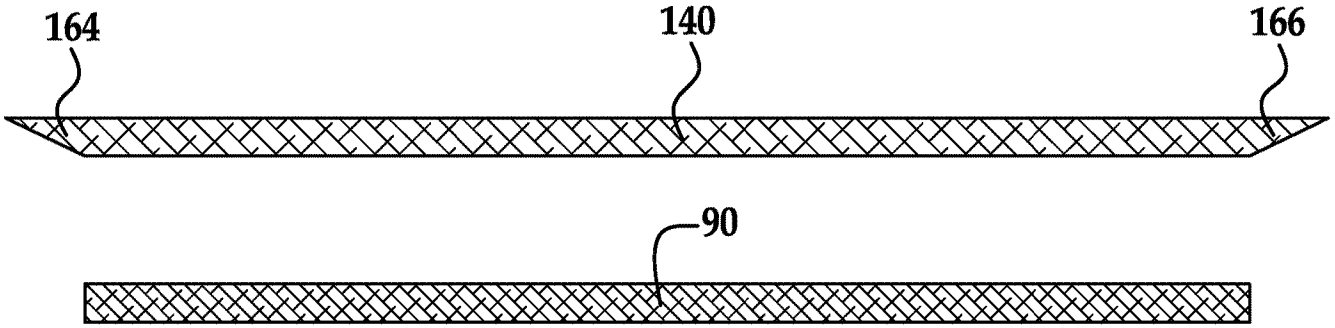
FIG. 35 is a cross-sectional schematic of the multi component layer and the first flexible layer of FIG. 34 taken along lines 35-35.

At step 302, the adhesive dispensing machine 284 disposes first, second, and third adhesive layers 40, 41, 42 on a top surface of the first flexible portion 90 in a longitudinal direction at the first and second end portions 110, 112 thereof and an intermediate portion thereof, respectively as shown in FIG. 34.

At step 304, the user disposes the first end portion 164 (shown in FIG. 37) of the first flexible layer 140 on the first adhesive layer 40 (shown in FIG. 34) on the top surface of the first flexible portion 90 to couple the first flexible layer 140 to the first flexible portion 90.

Figure 36:
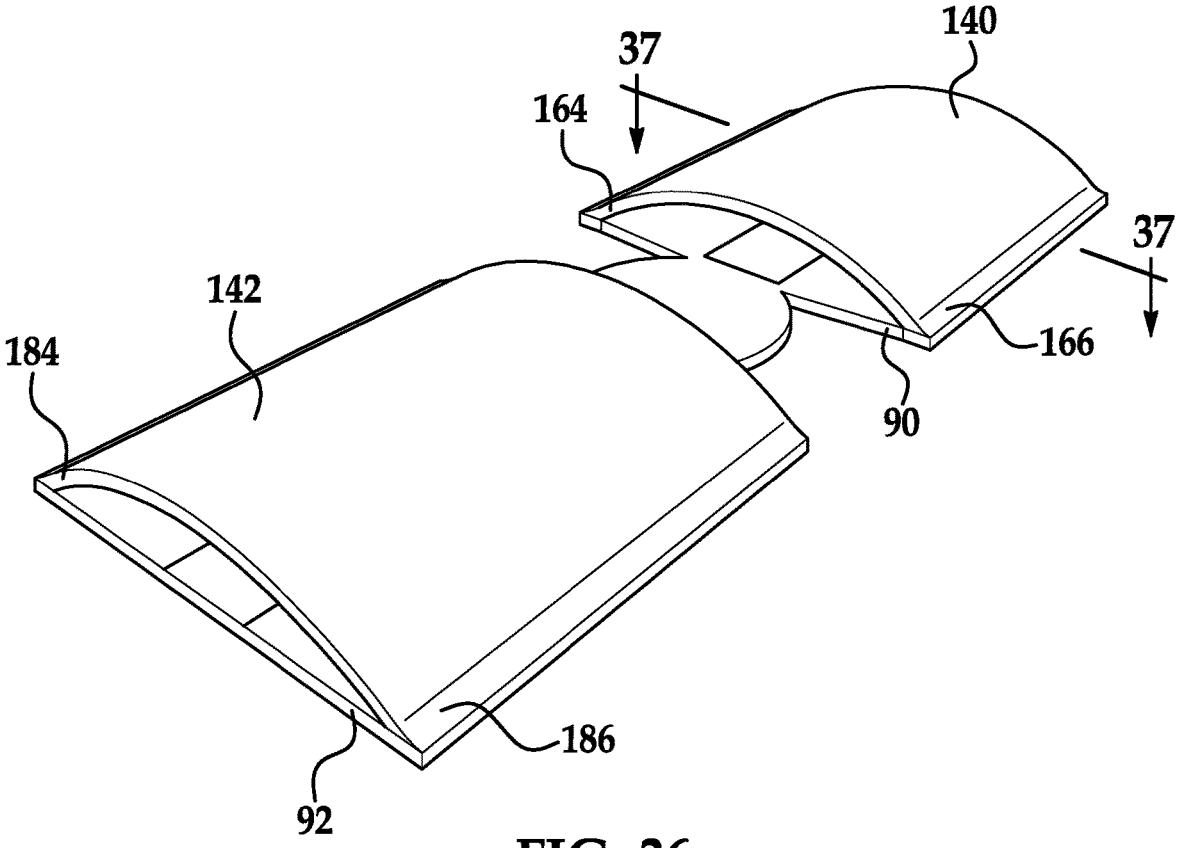
FIG. 36 is a schematic of the first and second flexible layers of FIG. 34 being disposed on the multi-component layer of FIG. 34.
Figure 37:
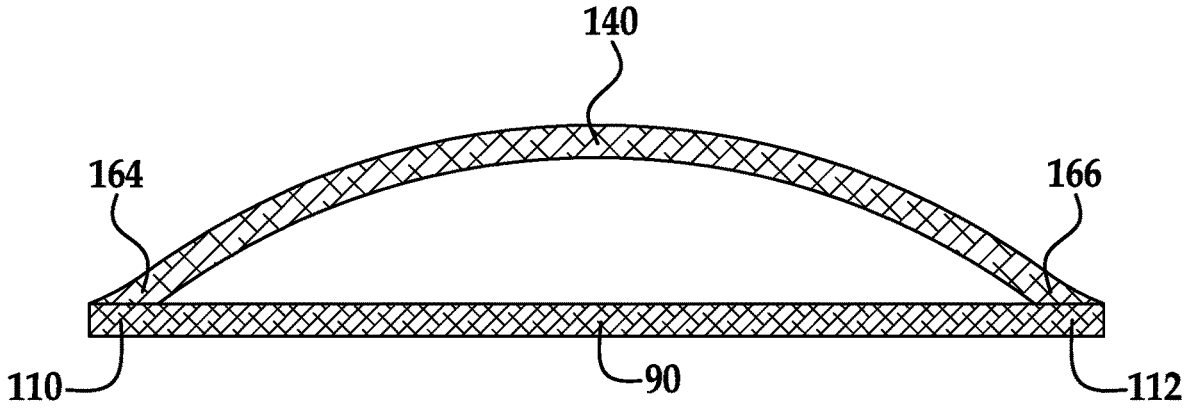
FIG. 37 is a cross-sectional schematic of the first and second flexible layers and the multicomponent layer of FIG. 36 taken along lines 37-37.

At step 306, the user disposes the second end portion 166 (shown in FIG. 37) of the first flexible layer 140 on the second adhesive layer 41 (shown in FIG. 34) on the top surface of the first flexible portion 90 to couple the first flexible layer 140 to the first flexible portion 90 as shown in FIGS. 34, 36 and 37.

At step 308, the user disposes an intermediate portion 168 (shown in FIG. 39) of the first flexible layer 140 on the third adhesive layer 42 (shown in FIG. 34) on the top surface of the first flexible portion 90 to couple the first flexible layer 140 to the first flexible portion 90, such that the first and second air gaps 60, 62 are formed between the first flexible layer 140 and the first flexible portion 90.

At step 320, the adhesive dispensing machine 284 disposes fourth, fifth, and sixth adhesive layers 43, 44, 45 on a top surface of the second flexible portion 92 in the longitudinal direction at first and second end portions 116, 118 thereof and an intermediate portion thereof, respectively as shown in FIG. 34.

At step 322, the user disposes the first end portion 184 (shown in FIG. 38) of the second flexible layer 142 on the fourth adhesive layer 43 (shown in FIG. 34) on the top surface of the second flexible portion 92 to couple the second flexible layer 142 to the second flexible portion 92 as shown in FIGS. 34, 36.

At step 324, the user disposes the second end portion 186 (shown in FIG. 38) of the second flexible layer 142 on the fifth adhesive layer 44 (shown in FIG. 34) on the top surface of the second flexible portion 92 to couple the second flexible layer 142 to the second flexible portion 92 as shown in FIGS. 34, 36.

Figure 38:
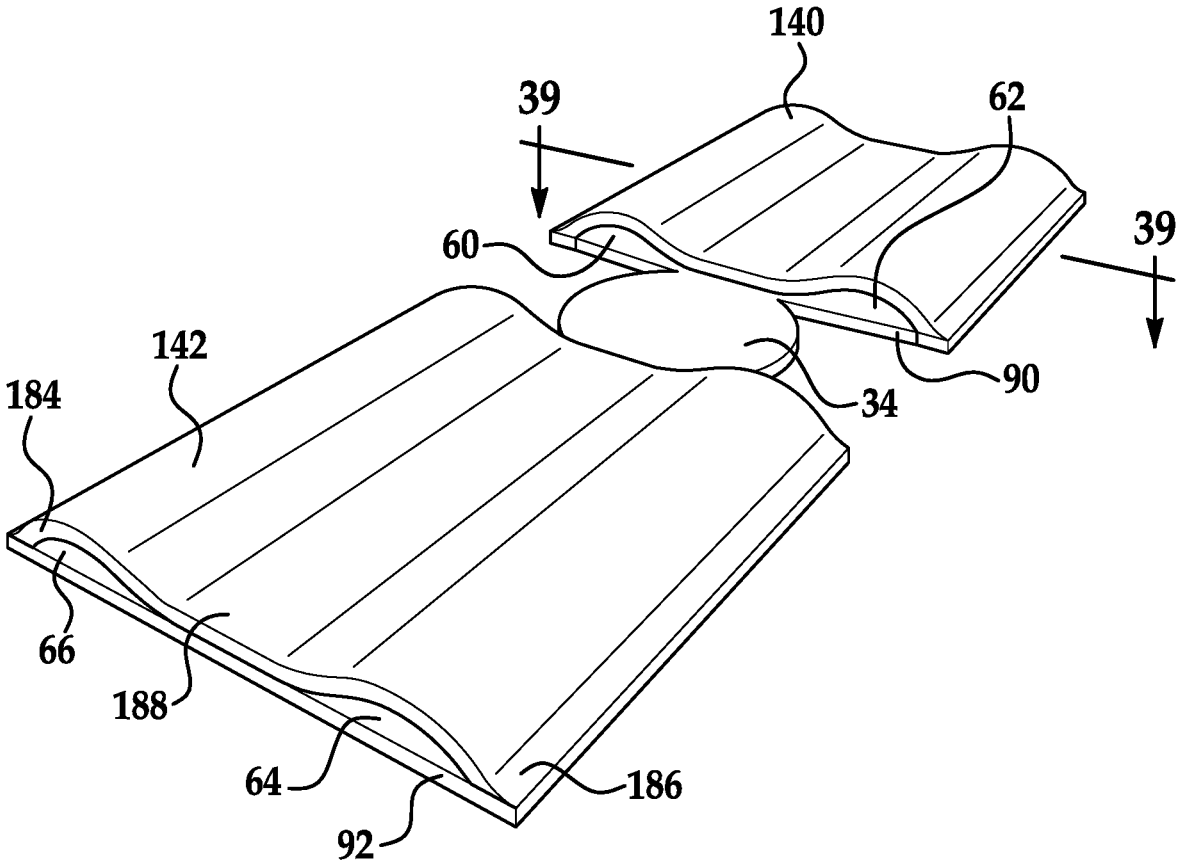
FIG. 38 is an isometric view of the first and second flexible layers of FIG. 34 being further disposed on the multi-component layer of FIG. 34.
Figure 39:
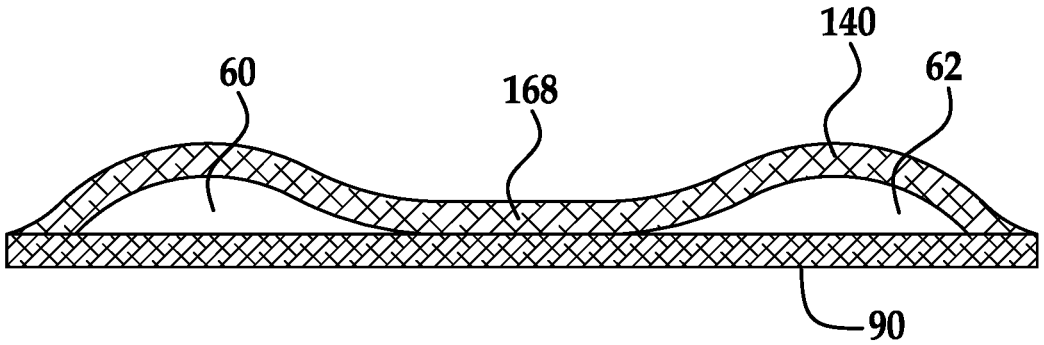
FIG. 39 is a cross-sectional schematic of the first and second flexible layers and the multi-component layer of FIG. 38 taken along lines 39-39.

At step 326, the user disposes an intermediate portion 188 (shown in FIG. 38) of the second flexible layer 142 on the sixth adhesive layer 45 (shown in FIG. 34) on the top surface of the second flexible portion 92 to couple the second flexible layer 142 to the second flexible portion 92, such that the third and fourth air gaps 64, 66 are formed between the second flexible layer 142 and the second flexible portion 92 as shown in FIGS. 34, 38.

Figure 40:
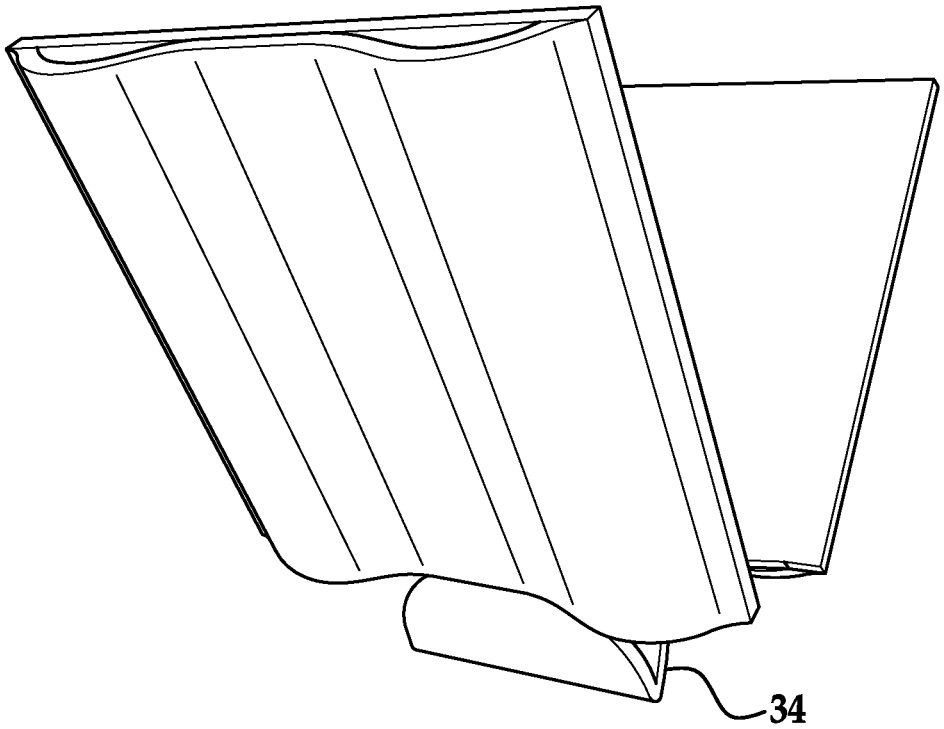
FIG. 40 is an isometric view of the multi-component layer of FIG. 38 being folded during assembly of a thermally insulating beverage jacket of FIG. 1.
Figure 41:
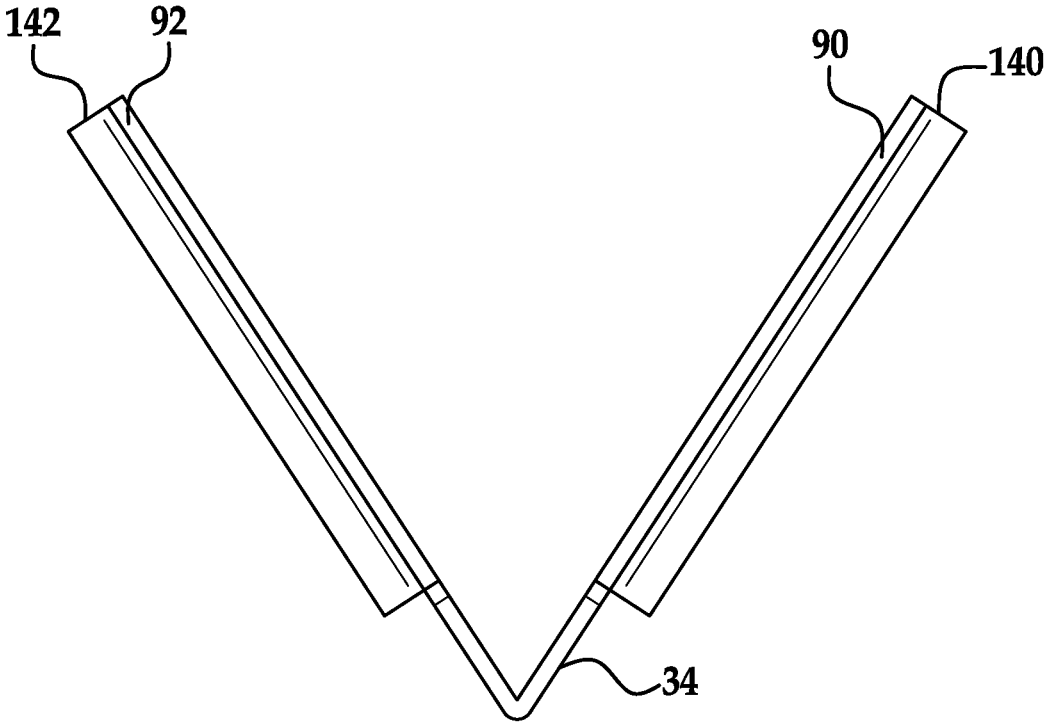
FIG. 41 is a side view of the multi-component layer of FIG. 40.
Figure 42:
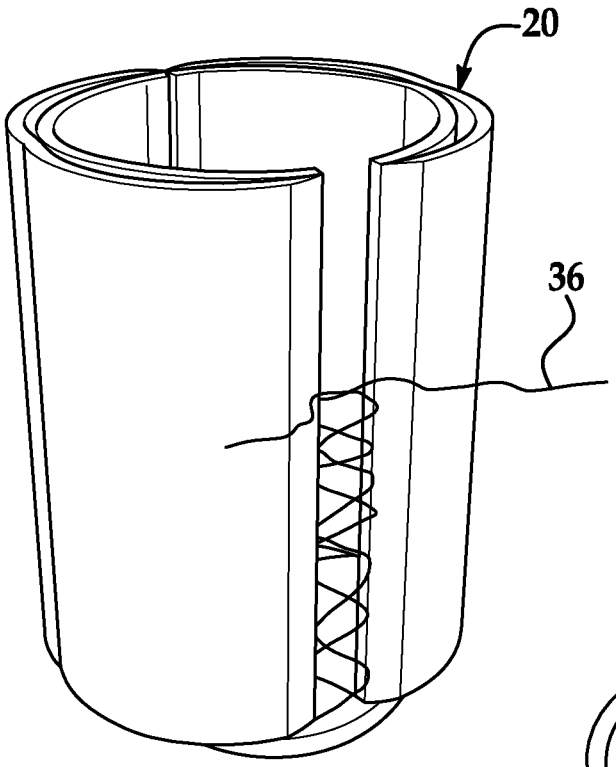
FIG. 42 is a partially assembled thermally insulating beverage jacket showing a first plurality of stitches utilized therein.
Figure 43:
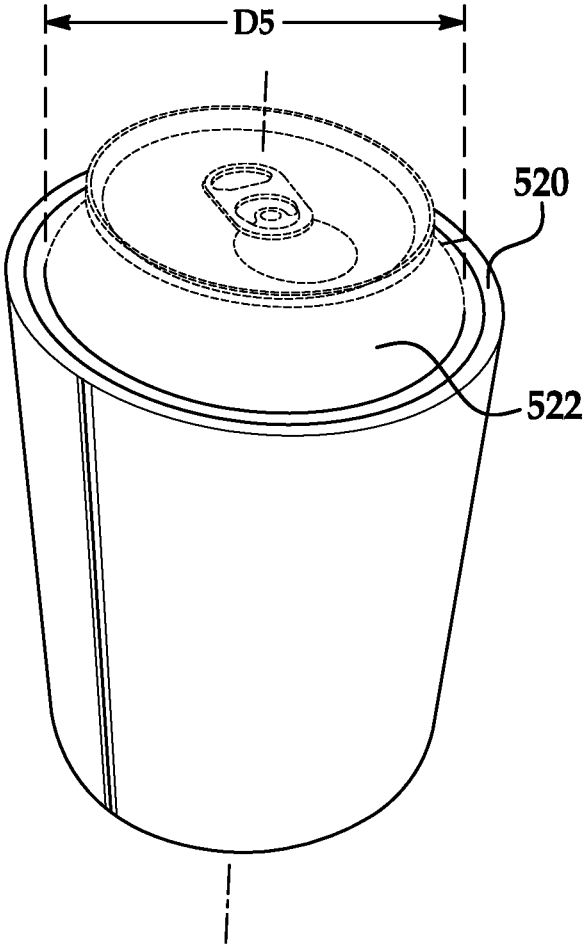
FIG. 43 is a schematic of a fourth beverage container (e.g., standard diameter beverage container) disposed within another thermally insulating beverage jacket, in accordance with another exemplary embodiment.

At step 328, the user folds the end flexible portion 34 such that the first and second flexible portions 90, 92 contact one another as shown in FIGS. 40, 41.

At step 340, the user utilizes the sewing machine 286 to sew a first plurality of stitches 36 (shown in FIG. 42) through the first end portion 164 of the first flexible layer 140, the first end portion 110 of the first flexible portion 90, the first end portion 184 of the second flexible layer 142, and the first end portion 116 of the second flexible portion 92.

At step 342, the user utilizes the sewing machine 286 to sew a second plurality of stitches 38 (shown in FIG. 8) through a second end portion 166 of the first flexible layer 140, a second end portion 112 of the first flexible portion 90, a second end portion 186 of the second flexible layer 142, and a second end portion 118 of the second flexible portion 92.

Figure 44:
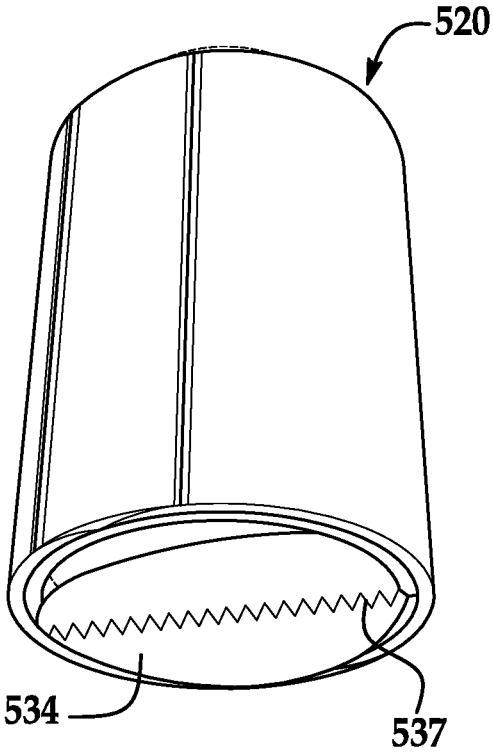
FIG. 44 is a schematic of the thermally insulating beverage jacket of FIG. 43 in a first operational position.
Figure 45:
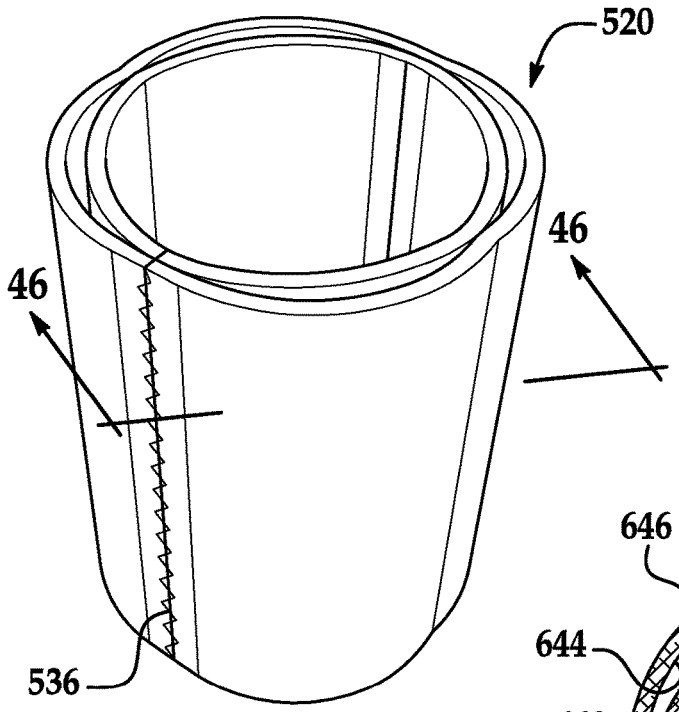
FIG. 45 is an isometric view of the thermally insulating beverage jacket of FIG. 43 in the first operational position for receiving a beverage container therein.
Figure 46:
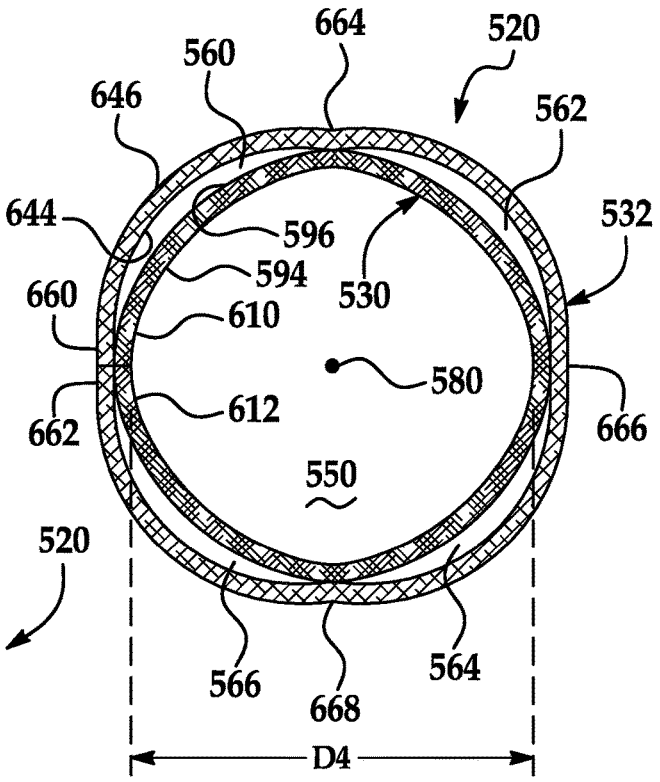
FIG. 46 is a cross-sectional schematic of the thermally insulating beverage jacket of FIG. 45 taken along lines 46-46.
Figure 54:
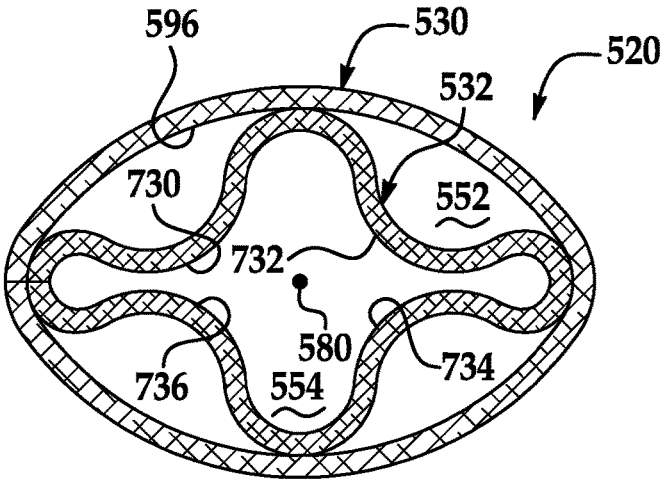
FIG. 54 is cross-sectional view of the thermally insulating beverage jacket of FIG. 52 taken along lines 54-54.
Figure 55:
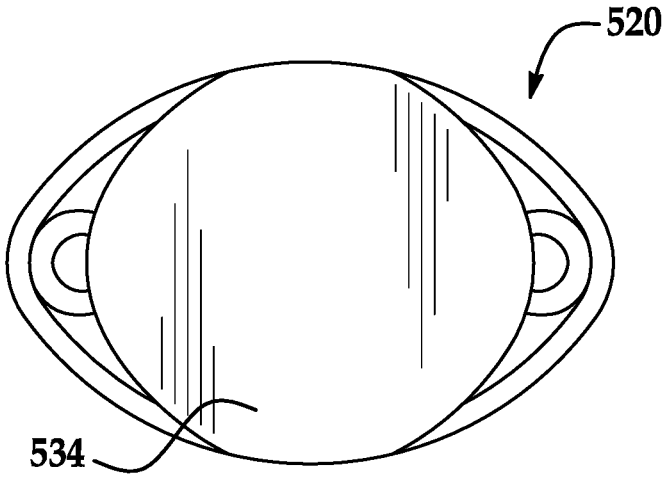
FIG. 55 is a bottom view of the thermally insulating beverage jacket of FIG. 52.
Figure 56:
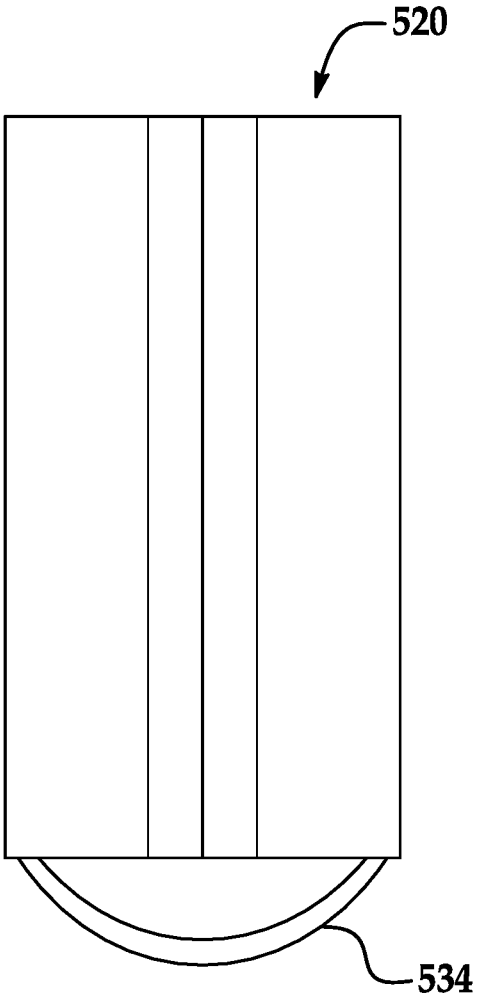
FIG. 56 is a first side view of the thermally insulating beverage jacket of FIG. 52.
Figure 57:
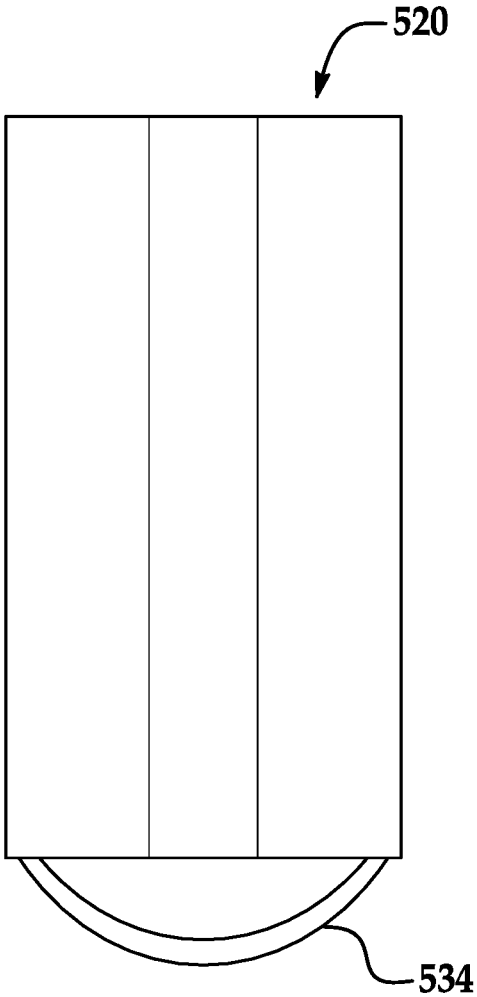
FIG. 57 is a second side view of the thermally insulating beverage jacket of FIG. 52.
Figure 58:
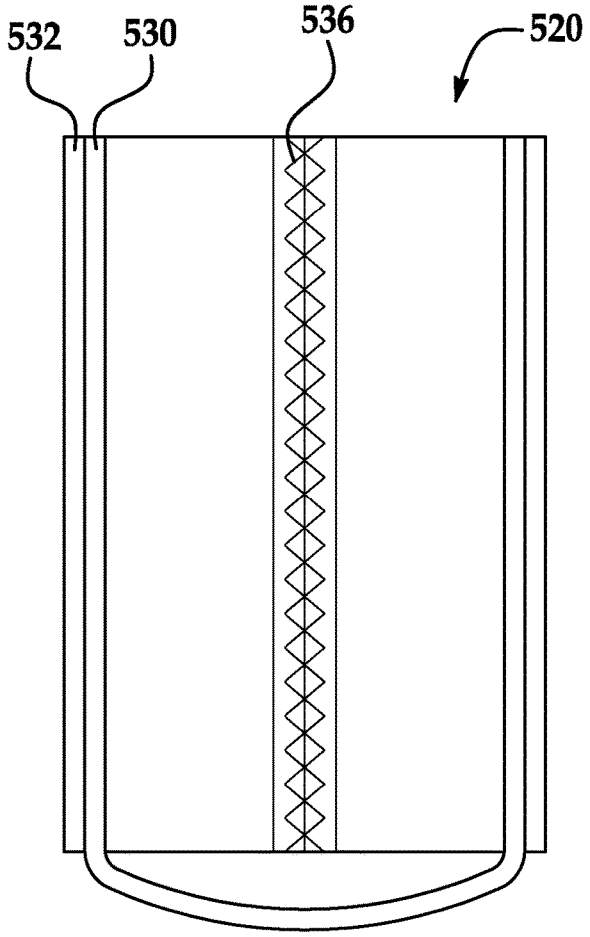
FIG. 58 is a cross-sectional view of the thermally insulating beverage jacket of FIG. 43 in the first operational position.
Figure 59:
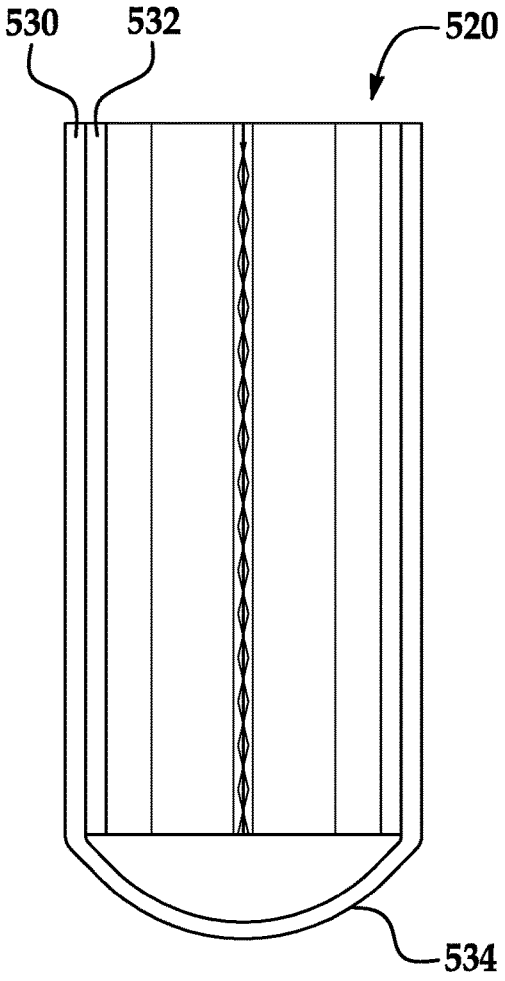
FIG. 59 is a cross-sectional view of the thermally insulating beverage jacket of FIG. 45 in a second operational position.
Figure 60:
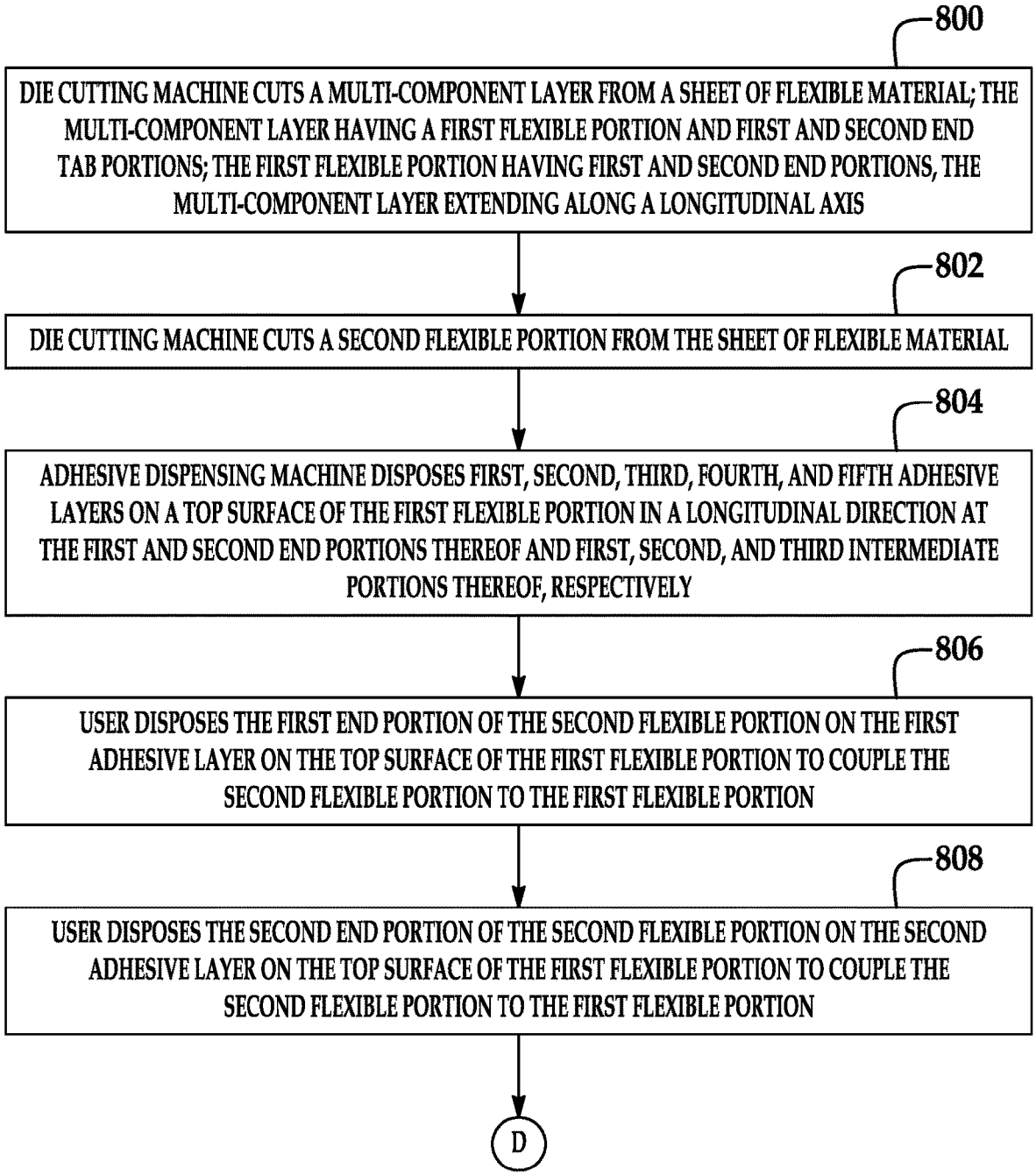
FIGS. 60-62 are flowcharts of a method of manufacturing the thermally insulating beverage jacket of FIG. 45.
Figure 61:
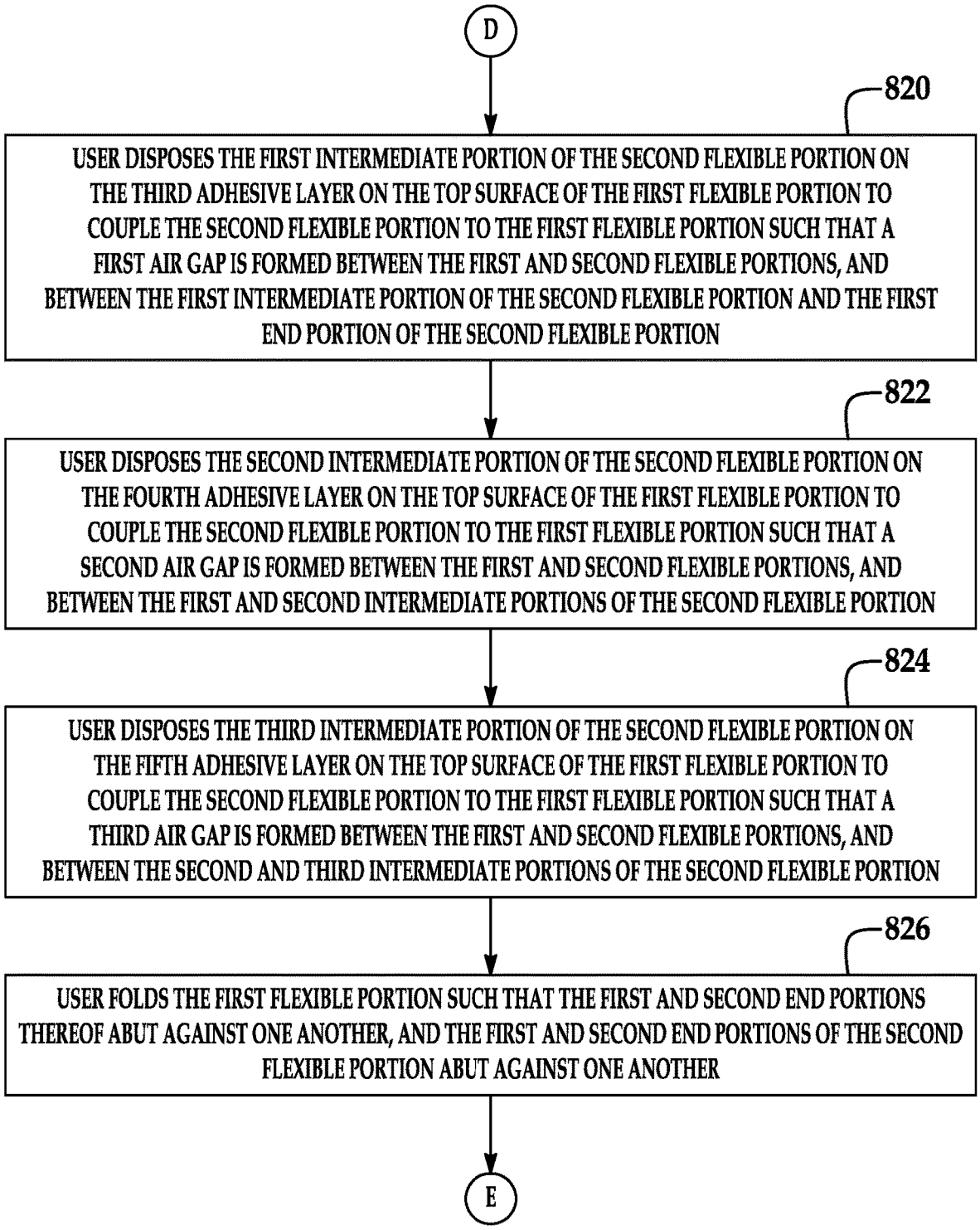
Figure 62:
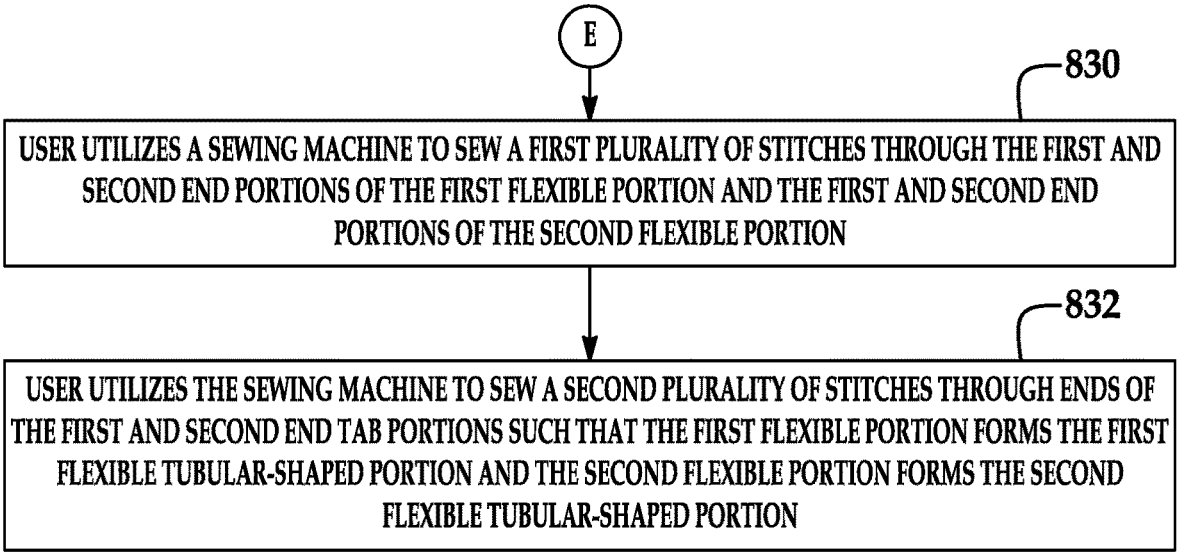
Figure 64:
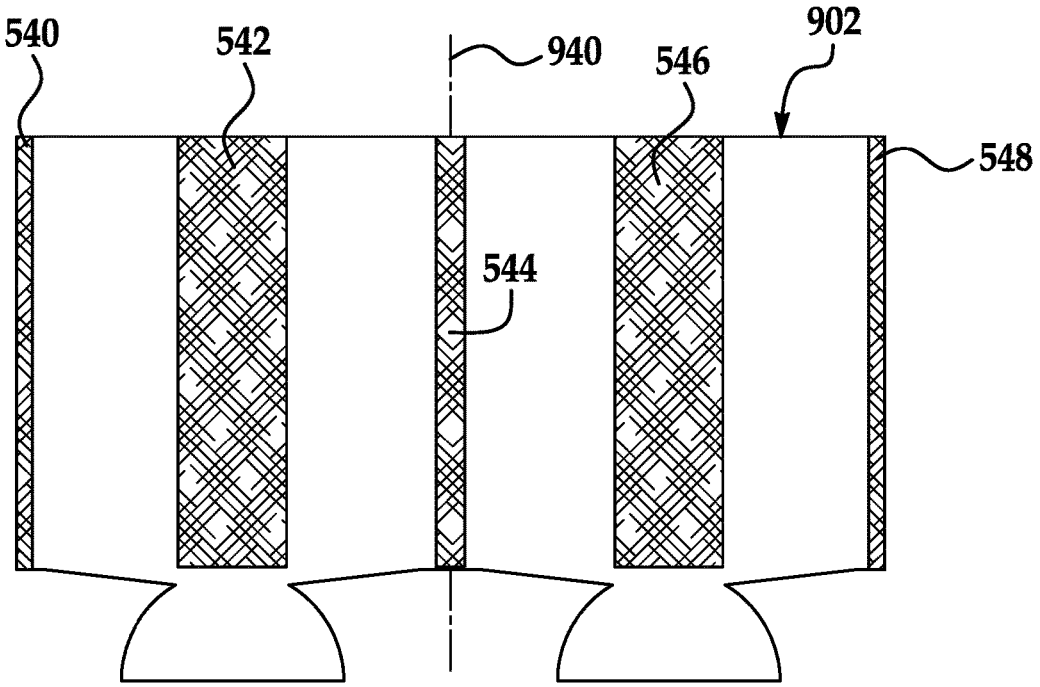
FIG. 64 is a schematic of a multi-component layer that is cut from the sheet of flexible material of FIG. 63 and having adhesive layers disposed therein.
Figure 65:
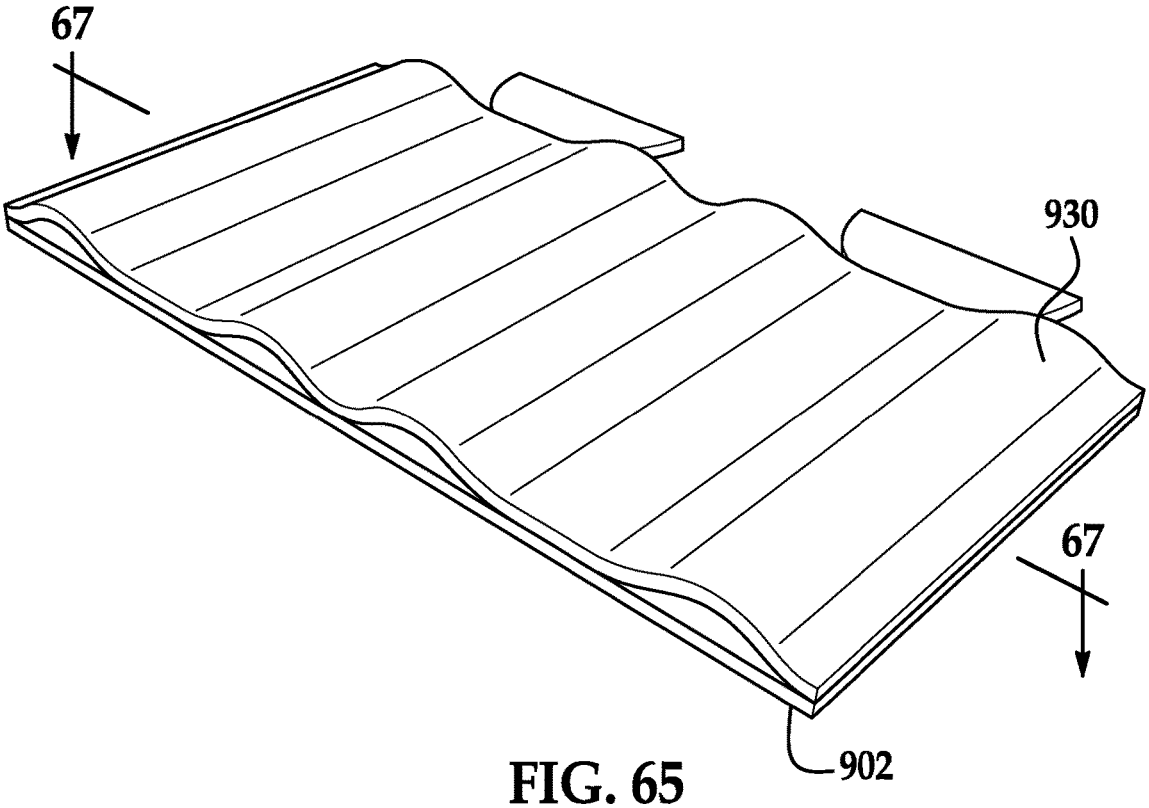
FIG. 65 is an isometric view of a flexible portion being disposed on the multi-component layer of FIG. 64.
Figure 66:
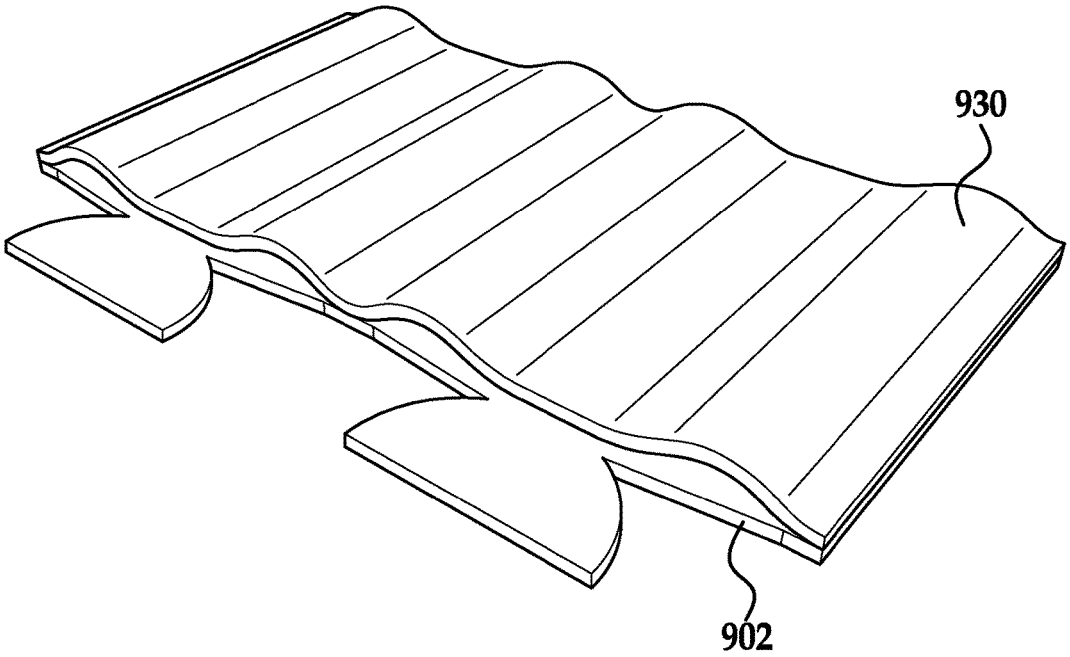
FIG. 66 is another isometric view of a flexible portion being disposed on the multi-component layer of FIG. 64.
Figure 67:
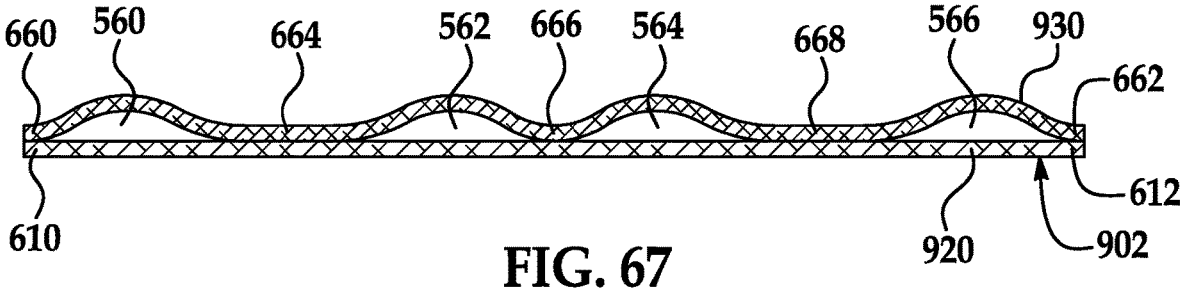
FIG. 67 is a cross-sectional view of the flexible portion being disposed on the multi-component layer of FIG. 65 taken along lines 67-67.
Figure 68:
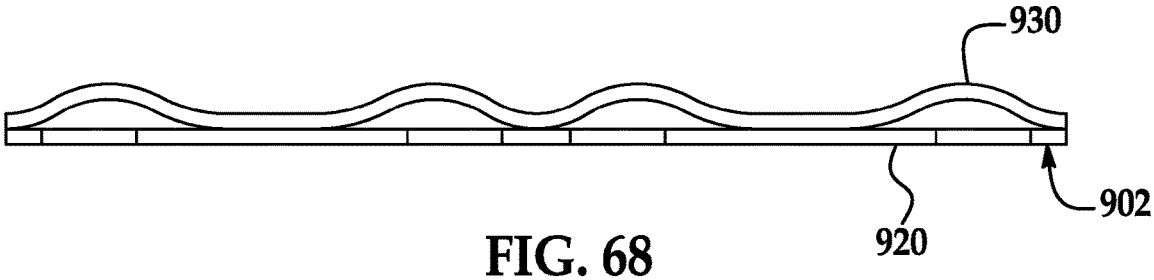
FIG. 68 is an end view of the flexible portion and the multi-component layer of FIG. 66.

Referring to FIGS. 43-58, the thermally insulating beverage jacket 520 includes a first flexible tubular-shaped portion 530 (shown in FIG. 46), a second flexible tubular-shaped portion 532, an end flexible portion 534 (shown in FIG. 44), a first plurality of stitches 536 (shown in FIG. 45), a second plurality of stitches 537 (shown in FIG. 44), adhesive layers 540, 542, 544, 546, 548 (shown in FIG. 64), first, second, and third interior regions 550, 552, 554 (shown in FIGS. 46 and 54), air gaps 560, 562, 564, 566 (shown in FIG. 46). The thermally insulating beverage jacket 520 extends along a longitudinal axis 580 and is centered about the longitudinal axis 580.

The structure of the thermally insulating beverage jacket 520 will initially be described with figures illustrating the thermally insulating beverage jacket 520 in a first operational position when a beverage container is not disposed within the thermally insulating beverage jacket 520.

Referring to FIG. 46, the first flexible tubular-shaped portion 530 includes a first surface 594, a second surface 596, a first end portion 610, and a second end portion 612. The first and second surfaces 594, 596 are disposed opposite to one another and each extend 360 degrees. The first end portion 610 abuts against the second end portion 612 and is coupled thereto utilizing a first plurality of stitches 536 (shown in FIG. 45). The first surface 594 defines a first interior region 550 with a first diameter D4 in the first operational position of the thermally insulating beverage jacket 530.

In an exemplary embodiment, the first flexible tubular-shaped portion 530 is constructed from a flexible open cell foam material. In another exemplary embodiment, the first flexible tubular-shaped portion 530 is constructed from a flexible open cell foam material covered with a thin fabric layer. In another exemplary embodiment, the first flexible tubular-shaped portion 530 is constructed of a flexible closed cell foam material. In another exemplary embodiment, the first flexible tubular-shaped portion 530 is constructed of a flexible closed cell foam material covered by a thin fabric layer. In another exemplary embodiment, the first flexible tubular-shaped portion 530 is constructed of a flexible silicone material. In another exemplary embodiment, the first flexible tubular-shaped portion 530 is constructed of a flexible silicone material covered with a thin layer of fabric. The first flexible tubular-shaped portion 530 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

The second flexible tubular-shaped portion 532 includes a first surface 644, a second surface 646, a first end portion 660, a second end portion 662, and first, second, third intermediate portions 664, 666, 668. The first and second surfaces 644, 646 are disposed opposite to one another. The first and second end portions 660, 662 and the intermediate portion 664 are coupled to and contact the second surface 596 of the first flexible tubular-shaped portion 530 such that the air gaps 560, 562 are formed between the first and second flexible tubular-shaped portion 530, 532 when the beverage container 522 is not disposed in the thermally insulating beverage jacket 520. The first and second end portions 660, 662 and the first, second, third intermediate portions 664, 666, 668 are coupled to the second surface 596 of the first flexible tubular-shaped portion 530 utilizing an adhesive, or stitches, or thermally welded joints.

In an exemplary embodiment, the second flexible tubular-shaped portion 532 is constructed from a flexible open cell foam material. In another exemplary embodiment, the second flexible tubular-shaped portion 532 is constructed from a flexible open cell foam material covered with a thin fabric layer. In another exemplary embodiment, the second flexible tubular-shaped portion 532 is constructed of a flexible closed cell foam material. In another exemplary embodiment, the second flexible tubular-shaped portion 532 is constructed of a flexible closed cell foam material covered by a thin fabric layer. In another exemplary embodiment, the second flexible tubular-shaped portion 532 is constructed of a flexible silicone material. In another exemplary embodiment, the second flexible tubular-shaped portion 532 is constructed of a flexible silicone material covered with a thin layer of fabric. The second flexible tubular-shaped portion 532 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma.

In an exemplary embodiment, referring to FIGS. 45 and 46, a first plurality of stitches 536 extend through the first and second end portions 610, 612 of the first flexible tubular-shaped portion 530 and the first and second end portions 660, 662 of the second flexible tubular-shaped portion 532.

Figure 47:
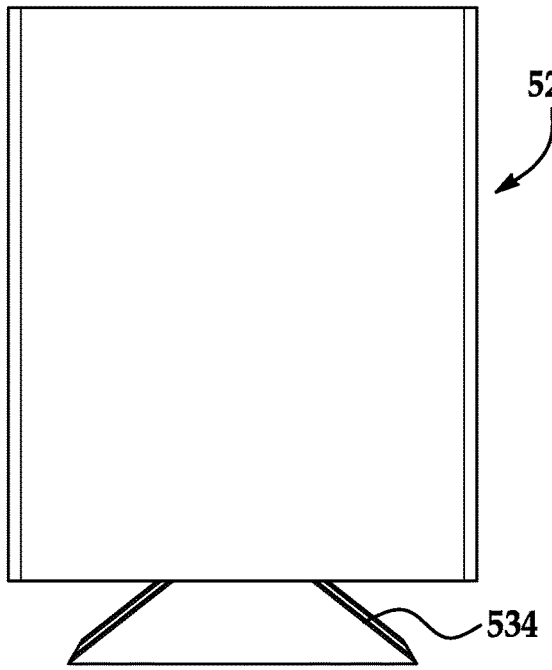
FIG. 47 is a side view of the thermally insulating beverage jacket of FIG. 45.

Referring to FIG. 47, the end flexible portion 534 is coupled to a first end of the first flexible tubular-shaped portion 530. In an exemplary embodiment, the end flexible portion 534 is constructed from a flexible open cell foam material. In another exemplary embodiment, the end flexible portion 534 is constructed from a flexible open cell foam material covered with a thin fabric layer. In another exemplary embodiment, the end flexible portion 534 is constructed of a flexible closed cell foam material. In another exemplary embodiment, the end flexible portion 534 is constructed of a flexible closed cell foam material covered by a thin fabric layer. In another exemplary embodiment, the end flexible portion 534 is constructed of a flexible silicone material. In another exemplary embodiment, the end flexible portion 534 is constructed of a flexible silicone material covered with a thin layer of fabric. The end flexible portion 534 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma. The end flexible portion 534 is an optional component and may be removed from an alternative embodiment of the thermally insulating beverage jacket 520 such that the alternative jacket would have two open ends.

Referring to FIGS. 45-46, in the first operational position of the thermally insulating beverage jacket 520, the second flexible tubular-shaped portion 532 is disposed radially outwardly from the longitudinal axis 580 a greater distance than the first flexible tubular-shaped portion 530. The first flexible tubular-shaped portion 530 has the first interior region 550 with a first diameter D4 (shown in FIG. 46) and stretches to receive the beverage container 522 having a second diameter D5 (shown in FIG. 43) that is greater than the first diameter D4 and to firmly hold the beverage container 522 therein.

The structure of the thermally insulating beverage jacket 520 will now be described with figures illustrating the thermally insulating beverage jacket 520 in a second operational position when a beverage container is not disposed within the thermally insulating beverage jacket 520.

The thermally insulating beverage jacket 520 is transitioned from the first operational position (shown in FIG. 45) to a second operational position (shown in FIG. 52) by turning the beverage jacket 520 inside-out by pushing the end flexible portion 534 through an entire longitudinal length of the first interior region 550. Afterward, the second flexible tubular-shaped portion 532 is disposed in a second interior region 552 defined by the second surface 596 of the first flexible tubular-shaped portion 530. The second flexible tubular-shaped portion 532 is disposed radially outwardly from the longitudinal axis 580 a smaller distance than the first flexible tubular-shaped portion 530 and forms protrusions 730, 732, 734, 736 that extend inwardly toward the longitudinal axis 580. The second flexible tubular-shaped portion 532 defines a third interior region 554 (shown in FIG. 54) and stretches to receive a beverage container 524 having a third diameter D6 (shown in FIG. 48) that is smaller than the first diameter D4 (shown in FIG. 46) and to firmly hold the beverage container 524 therein.

Figure 48:
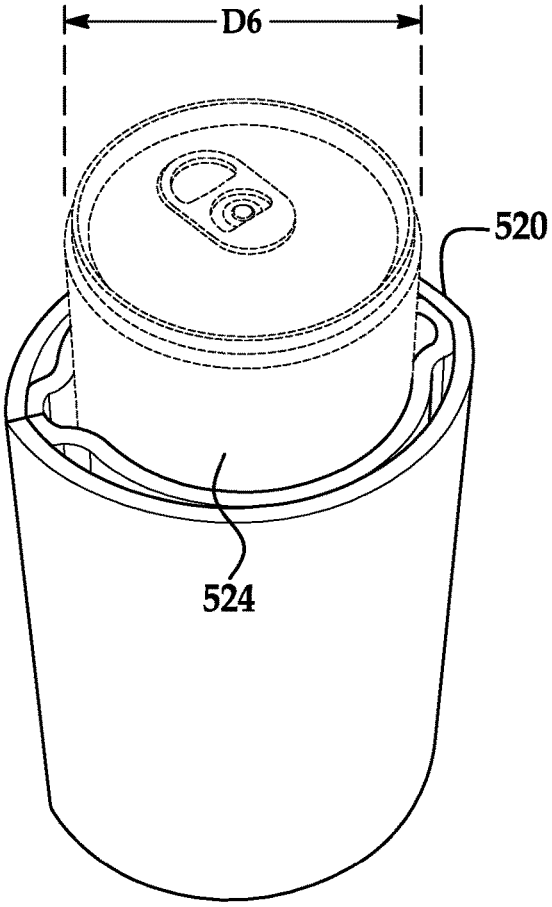
FIG. 48 is a schematic of a fifth beverage container (e.g., small diameter beverage container) disposed within the thermally insulating beverage jacket of FIG. 45.
Figure 50:
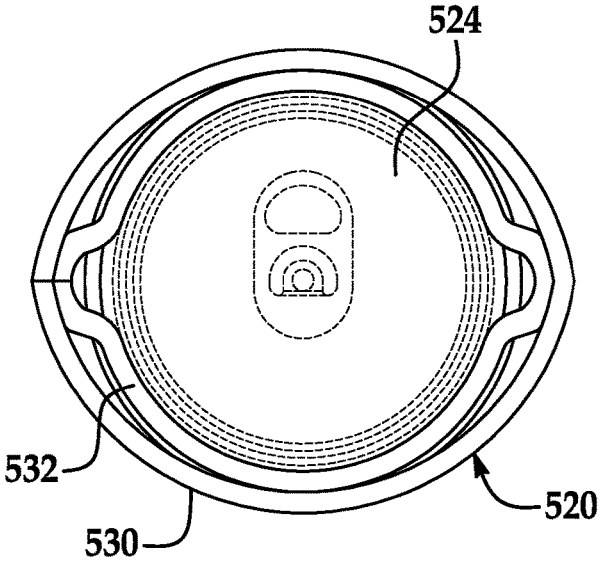
FIG. 50 is a top view of the fifth beverage container and the thermally insulating beverage jacket of FIG. 48.

Referring to FIGS. 48 and 50, the thermally insulating beverage jacket 520 in the second operational position can receive a beverage container 524 therein and firmly hold the container 524 therein. The beverage container 524 has a 52 mm diameter and holds 8.4 ounces of fluid.

Figure 49:
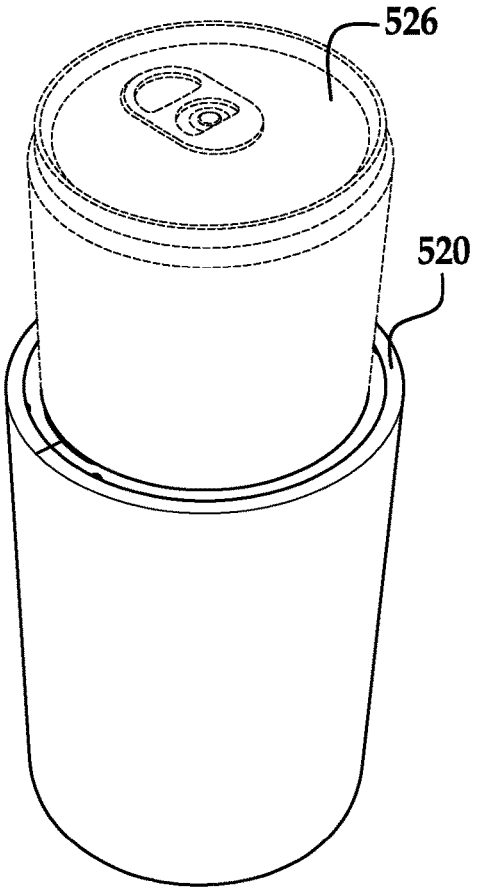
FIG. 49 is a schematic of a sixth beverage container (e.g., small diameter beverage container) disposed within the thermally insulating beverage jacket of FIG. 43.
Figure 51:
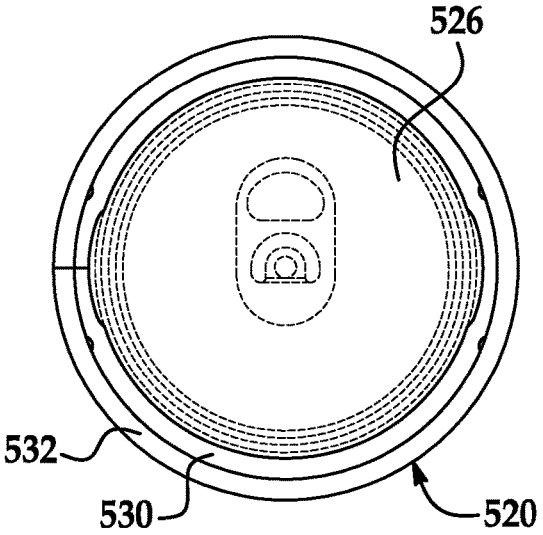
FIG. 51 is a top view of the sixth beverage container and the thermally insulating beverage jacket of FIG. 49.
Figure 52:
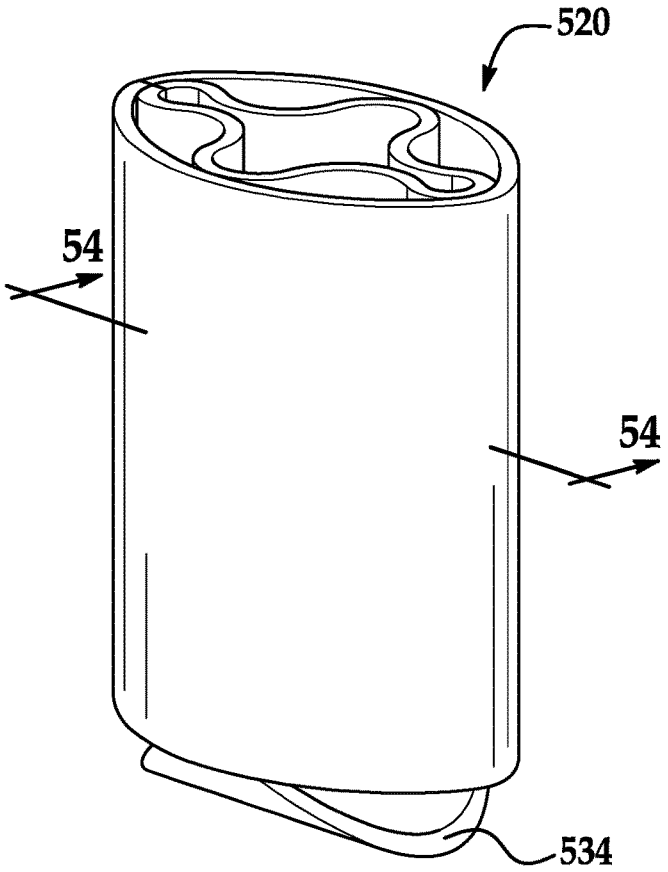
FIG. 52 is an isometric view of the thermally insulating beverage jacket of FIG. 45 in a second operational position for receiving a beverage container therein.
Figure 53:
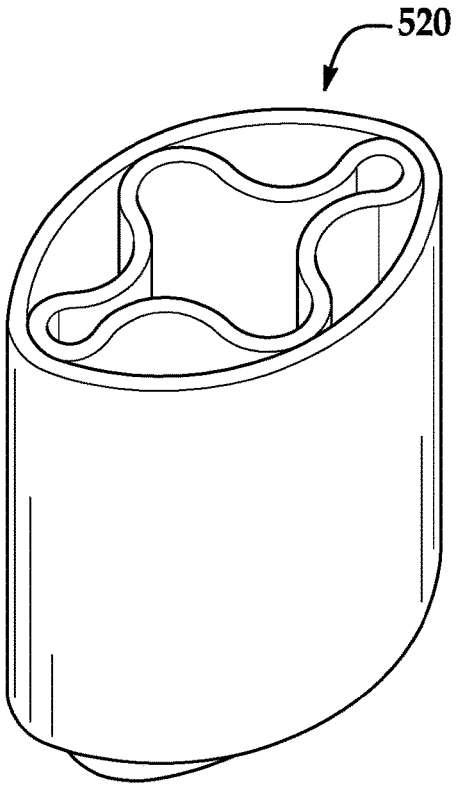
FIG. 53 is another isometric view of the thermally insulating beverage jacket of FIG. 45 in the second operational position.

Referring to FIGS. 49 and 51, the thermally insulating beverage jacket 520 in the second operational position can receive a beverage container 526 therein and firmly hold the container 526 therein. The beverage container 526 has a 57 mm diameter and holds 12 ounces of fluid.

Referring to FIGS. 46, 60-62, and 63-70, a flowchart of a method of manufacturing the thermally insulating beverage jacket 520 will now be explained.

Figure 63:
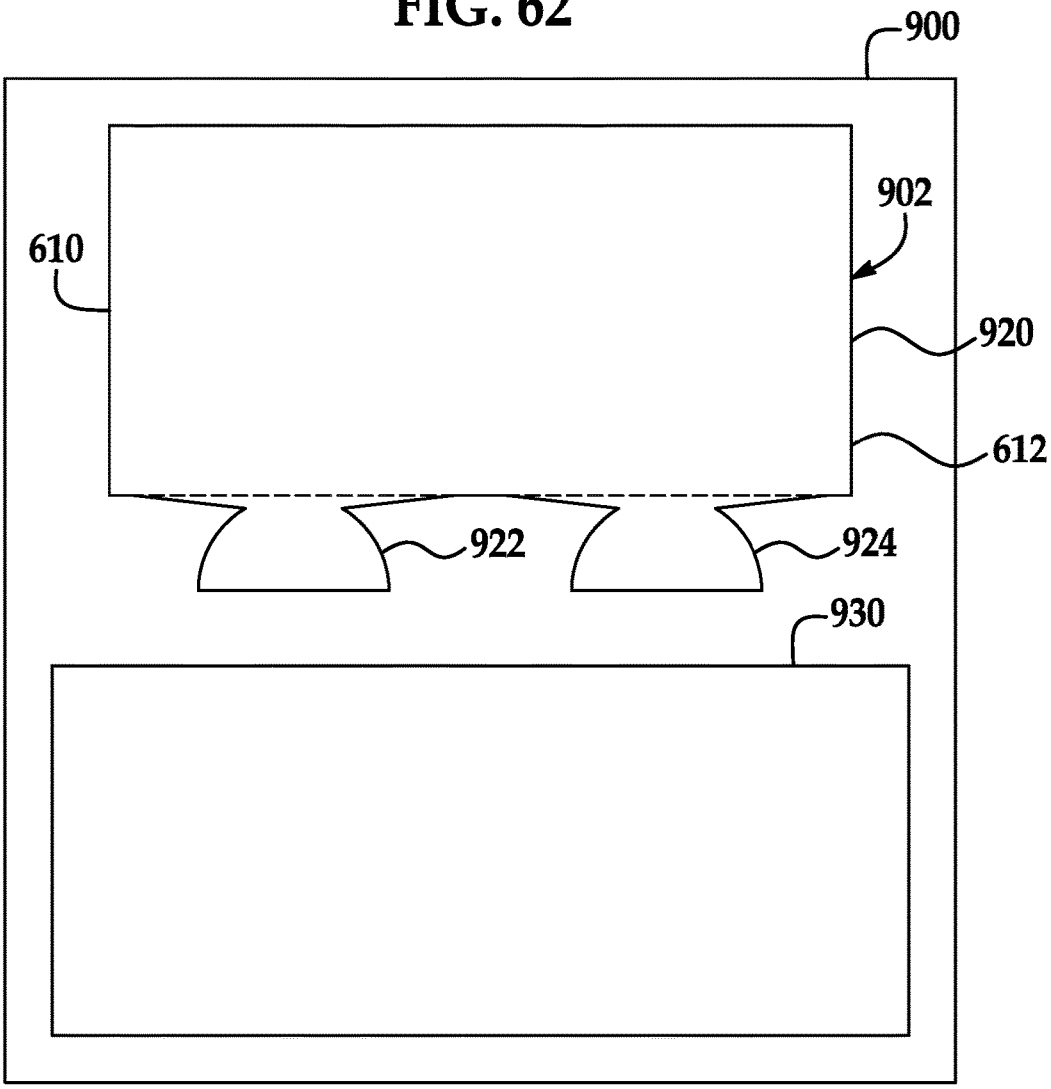
FIG. 63 is a schematic of a sheet of flexible material utilized to manufacture the thermally insulating beverage jacket of FIG. 45.

At step 800, the die cutting machine 282 cuts a multi-component layer 902 from a sheet of flexible material 900 (shown in FIG. 63). The multi-component layer 902 has a first flexible portion 920 and first and second end tab portions 922, 924. The first flexible portion 920 has first and second end portions 610, 612. The multi-component layer 902 extends along a longitudinal axis 940 (shown in FIG. 64). In an exemplary embodiment, the sheet of flexible material 900 is constructed from a flexible open cell foam material. In another exemplary embodiment, the sheet of flexible material 900 is constructed from a flexible open cell foam material covered with a thin fabric layer. In another exemplary embodiment, the sheet of flexible material 900 is constructed of a flexible closed cell foam material. In another exemplary embodiment, the sheet of flexible material 900 is constructed of a flexible closed cell foam material covered by a thin fabric layer. In another exemplary embodiment, the sheet of flexible material 900 is constructed of a flexible silicone material. In another exemplary embodiment, the sheet of flexible material 900 is constructed of a flexible silicone material covered with a thin layer of fabric. The sheet of flexible material 900 has a thickness in a range of 2-4 millimeters. The flexible open cell foam material can comprise at least one of a polyurethane (polymer) open cell foam, a reticulated open cell foam, and an open cell rubber for example. The flexible closed cell foam material can comprise at least one of a polymer form Neoprene and ethylene propylene diene terpolymer (EPDM) for example. Further, the flexible silicone material can comprise at least one of Norseal, Bellofoam, and Soma Foma. The first flexible portion 920 is rectangular-shaped.

At step 802, the die cutting machine 282 cuts a second flexible portion 930 (shown in FIG. 63) from the sheet of flexible material 900. The second flexible portion 930 is rectangular-shaped.

At step 804, the adhesive dispensing machine 284 disposes first, second, third, fourth, and fifth adhesive layers 540, 542, 544, 546, 548 (shown in FIG. 64) on a top surface of the first flexible portion 920 in a longitudinal direction at the first and second end portions 610, 612 thereof and first, second, and third intermediate portions thereof, respectively.

At step 806, the user disposes the first end portion 660 (shown in FIGS. 65-67) of the second flexible portion 930 on the first adhesive layer 540 (shown in FIG. 64) on the top surface of the first flexible portion 920 to couple the second flexible portion 930 to the first flexible portion 920.

At step 808, the user disposes the second end portion 662 (shown in FIGS. 65-67) of the second flexible portion 930 on the second adhesive layer 548 (shown in FIG. 64) on the top surface of the first flexible portion 920 to couple the second flexible portion 930 to the first flexible portion 920.

At step 820, the user disposes the first intermediate portion of the second flexible portion 930 on the third adhesive layer 542 (shown in FIG. 64) on the top surface of the first flexible portion 920 to couple the second flexible portion 930 to the first flexible portion 920 such that a first air gap 560 (shown in FIG. 67) is formed between the first and second flexible portions 920, 930, and between the first intermediate portion of the second flexible portion 930 and the first end portion 660 of the second flexible portion 930.

At step 822, the user disposes the second intermediate portion of the second flexible portion 930 on the fourth adhesive layer 544 (shown in FIG. 64) on the top surface of the first flexible portion 920 to couple the second flexible portion 930 to the first flexible portion 920 such that a second air gap 562 (shown in FIG. 67) is formed between the first and second flexible portions 920, 930, and between the first and second intermediate portions of the second flexible portion 930.

At step 824, the user disposes the third intermediate portion of the second flexible portion 930 on the fifth adhesive layer 546 (shown in FIG. 64) on the top surface of the first flexible portion 920 to couple the second flexible portion 930 to the first flexible portion 920 such that a third air gap 564 (shown in FIG. 67) is formed between the first and second flexible portions 920, 930, and between the second and third intermediate portions of the second flexible portion 930.

At step 826, the user folds the first flexible portion 920 such that the first and second end portions 610, 612 thereof abut against one another, and the first and second end portions 660, 662 of the second flexible portion 930 abut against one another.

At step 830, the user utilizes the sewing machine 286 to sew a first plurality of stitches 536 (shown in FIG. 45) through the first and second end portions 610, 612 of the first flexible portion 920 and the first and second end portions 660, 662 of the second flexible portion 930.

At step 832, the user utilizes the sewing machine 286 to sew a second plurality of stitches 537 (shown in FIG. 44) through ends of the first and second end tab portions 922, 924 such that the first flexible portion 920 forms the first flexible tubular-shaped portion 530 and the second flexible portion 930 forms the second flexible tubular-shaped portion 532.

The thermally insulating beverage jackets described herein provide a substantial advantage over other beverage jackets. In particular, each inventive thermally insulating beverage jacket firmly holds beverage cans having a plurality of different sizes therein. In particular, each thermally insulating beverage jacket can hold beverage containers having diameters in a range of 52-74 mm in diameter. Thus, a user does not have to use multiple beverage jackets to hold multiple beverage containers having different sizes.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A thermally insulating beverage jacket, comprising:

a first flexible tubular-shaped portion having first and second surfaces disposed opposite to one another, the first surface defining a first interior region with a first diameter in a first operational position of the thermally insulating beverage jacket, the first flexible tubular-shaped portion being centered about a longitudinal axis;

an end flexible portion coupled to a first end of the first flexible tubular-shaped portion;

a second flexible tubular-shaped portion coupled to the second surface of the first flexible tubular-shaped portion and having at least first and second air gaps therebetween in the first operational position of the thermally insulating beverage jacket;

such that in the first operational position of the thermally insulating beverage jacket in which the second flexible tubular-shaped portion is disposed radially outwardly from the longitudinal axis a greater distance than the first flexible tubular-shaped portion, the first flexible tubular-shaped portion having the first interior region and stretches to receive a first beverage container having a second diameter that is greater than the first diameter and to firmly hold the first beverage container therein; and in a second operational position of the thermally insulating beverage jacket in which the thermally insulating beverage jacket is turned inside-out, and the second flexible tubular-shaped portion is disposed in a second interior region defined by the second surface of the first flexible tubular-shaped portion, the second flexible tubular-shaped portion forming at least first and second protrusions, respectively, that extend inwardly toward the longitudinal axis, the second flexible tubular-shaped portion defining a third interior region and stretches to receive a second beverage container having a third diameter that is smaller than the first diameter and to firmly hold the second beverage container therein.

2. The thermally insulating beverage jacket of claim 1, wherein:

the second flexible tubular-shaped portion comprises first and second flexible layers;

the first flexible layer coupled to the second surface of the first flexible tubular-shaped portion and having at least the first air gap therebetween prior to the first and second beverage containers being disposed in the thermally insulating beverage jacket; and the second flexible layer coupled to the second surface of the first flexible tubular-shaped portion and having at least the second air gap therebetween prior to the first and second beverage containers being disposed in the thermally insulating beverage jacket.

3. The thermally insulating beverage jacket of claim 2, wherein:

in the first operational position of the thermally insulating beverage jacket, the first and second flexible layers are disposed radially outwardly from the longitudinal axis a greater distance than the first flexible tubular-shaped portion; and in the second operational position of the thermally insulating beverage jacket, the first and second flexible layers are disposed radially outwardly from the longitudinal axis a smaller distance than the first flexible tubular-shaped portion and form at least the first and second protrusions, respectively, that extend inwardly toward the longitudinal axis; and the first diameter of the first flexible tubular-shaped portion is perpendicular to the longitudinal axis.

4. The thermally insulating beverage jacket of claim 2, wherein:

the first flexible layer having first and second end portions and an intermediate portion that are coupled to and contacting the second surface of the first flexible tubular-shaped portion such that the first air gap and a third air gap are formed between the first flexible layer and the second surface of the flexible tubular-shaped portion when the first beverage container is not disposed in the thermally insulating beverage jacket.

5. The thermally insulating beverage jacket of claim 4, wherein:

the first flexible layer extends around substantially 180 degrees of the first flexible tubular-shaped portion, and the first and second end portions of the first flexible layer are wedge-shaped.

6. The thermally insulating beverage jacket of claim 5, wherein:

the second flexible layer having first and second end portions and an intermediate portion that are coupled to and contacting the second surface of the first flexible tubular-shaped portion such that the second air gap and a fourth air gap are formed between the second flexible layer and the second surface of the first flexible tubular-shaped portion when the first beverage container is not disposed in the thermally insulating beverage jacket.

7. The thermally insulating beverage jacket of claim 6, wherein:

the second flexible layer extends around substantially 180 degrees of the first flexible tubular-shaped portion, and the first and second end portions of the second flexible layer are wedge-shaped.

8. The thermally insulating beverage jacket of claim 2, further comprising:

a first plurality of stitches extending through the first end portion of the first flexible layer of the second flexible tubular-shaped portion, the first flexible tubular-shaped portion, and the first end portion of the second flexible layer of the second flexible tubular-shaped portion to couple together the first end portion of the first flexible layer, the first flexible tubular-shaped portion, and the first end portion of the second flexible layer; and a second plurality of stitches extending through the second end portion of the first flexible layer of the second flexible tubular-shaped portion, the first flexible tubular-shaped portion, and the second end portion of the second flexible layer of the second flexible tubular-shaped portion to couple together the second end portion of the first flexible layer, the first flexible tubular-shaped portion, and the second end portion of the second flexible layer.

9. The thermally insulating beverage jacket of claim 1, wherein:

the first and second flexible tubular-shaped portions and the end flexible portion are each constructed from at least one of a flexible open cell foam material, a flexible closed cell foam material, and a silicone material.

10. The thermally insulating beverage jacket of claim 1, wherein:

the first and second flexible tubular-shaped portions and the end flexible portion each have a thickness in a range of 2-4 millimeters, and the second diameter is in a range of 61-74 millimeters, and the third diameter is in a range of 52-66 millimeters.

11. The thermally insulating beverage jacket of claim 1, wherein:

in the first operational position of the thermally insulating beverage jacket, the second flexible tubular-shaped portion is disposed radially outwardly from the longitudinal axis a greater distance than the first flexible tubular-shaped portion; and in the second operational position of the thermally insulating beverage jacket, the second flexible tubular-shaped portion is disposed radially outwardly from the longitudinal axis a smaller distance than the first flexible tubular-shaped portion and forms at least the first and second protrusions, respectively, that extend inwardly toward the longitudinal axis; and the first diameter of the first flexible tubular-shaped portion is perpendicular to the longitudinal axis.

12. The thermally insulating beverage jacket of claim 11, wherein:

the second flexible tubular-shaped portion having first and second end portions and at least first and second intermediate portions that are coupled to and contacting the second surface of the first flexible tubular-shaped portion, the first and second end portions of the second flexible tubular-shaped portion contacting one another and the first air gap being formed between the first end portion of the second flexible tubular-shaped portion and the first intermediate portion thereof, and the second air gap being formed between the second intermediate portion of the second flexible tubular-shaped portion and the second end portion thereof.

13. The thermally insulating beverage jacket of claim 12, wherein:

the first flexible tubular-shaped portion having first and second end portions that are coupled to the second surface of the second flexible tubular-shaped portion at the first and second end portions, respectively, of the second flexible tubular-shaped portion; and a first plurality of stitches extending through the first end portion of the second flexible tubular-shaped portion, the first end portion of the first flexible tubular-shaped portion, the second end portion of the second flexible tubular-shaped portion, and the second end portion of the first flexible tubular-shaped portion.

14. The thermally insulating beverage jacket of claim 11, wherein:

the first and second flexible tubular-shaped portions and the end flexible portion are each constructed from at least one of a flexible open cell foam material and a flexible closed cell foam material.

15. The thermally insulating beverage jacket of claim 11, wherein:

the first and second flexible tubular-shaped portions and the end flexible portion each have a thickness in a range of 2-4 millimeters, and the second diameter is in a range of 61-74 millimeters, and the third diameter is in a range of 52-66 millimeters.

16. A method of using a thermally insulating beverage jacket, comprising:

providing the thermally insulating beverage jacket having first and second flexible tubular-shaped portions and an end flexible portion; the first flexible tubular-shaped portion having first and second surfaces disposed opposite to one another, the first surface defining a first interior region with a first diameter in a first operational position of the thermally insulating beverage jacket, the first flexible tubular-shaped portion being centered about a longitudinal axis; the end flexible portion coupled to a first end of the first flexible tubular-shaped portion; the second flexible tubular-shaped portion coupled to the second surface of the first flexible tubular-shaped portion and having at least first and second air gaps therebetween in the first operational position of the thermally insulating beverage jacket;

moving the thermally insulating beverage jacket to the first operational position in which the second flexible tubular-shaped portion is disposed radially outwardly from the longitudinal axis a greater distance than the first flexible tubular-shaped portion; and inserting a first beverage container in the first interior region such that the first flexible tubular-shaped portion stretches to receive the first beverage container and to firmly hold the first beverage container therein, the first beverage container having a second diameter that is greater than the first diameter.

17. The method of claim 16, further comprising:

removing the first beverage container from the first interior region of the first flexible tubular-shaped portion;

moving the thermally insulating beverage jacket to a second operational position in which the thermally insulating beverage jacket is turned inside-out and the second flexible tubular-shaped portion is disposed in a second interior region defined by the second surface of the first flexible tubular-shaped portion, the second flexible tubular-shaped portion forming at least first and second protrusions, respectively, that extend inwardly toward the longitudinal axis, the second flexible tubular-shaped portion defining a third interior region; and inserting a second beverage container in the third interior region such that the second flexible tubular-shaped portion stretches to receive the second beverage container and to firmly hold the second beverage container therein, the second beverage container having a third diameter that is less than the first diameter.

* * * * *